US010436496B2

(12) United States Patent
Ikeda et al.

(10) Patent No.: US 10,436,496 B2
(45) Date of Patent: Oct. 8, 2019

(54) INDOOR UNIT FOR AIR-CONDITIONING APPARATUS

(71) Applicants: Takashi Ikeda, Tokyo (JP); Takahide Tadokoro, Tokyo (JP); Mitsuhiro Shirota, Tokyo (JP); Seiji Hirakawa, Tokyo (JP); Koji Yamaguchi, Tokyo (JP); Koichi Umetsu, Tokyo (JP)

(72) Inventors: Takashi Ikeda, Tokyo (JP); Takahide Tadokoro, Tokyo (JP); Mitsuhiro Shirota, Tokyo (JP); Seiji Hirakawa, Tokyo (JP); Koji Yamaguchi, Tokyo (JP); Koichi Umetsu, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 799 days.

(21) Appl. No.: 14/389,428

(22) PCT Filed: Oct. 4, 2012

(86) PCT No.: PCT/JP2012/075780
§ 371 (c)(1),
(2) Date: Sep. 30, 2014

(87) PCT Pub. No.: WO2013/150673
PCT Pub. Date: Oct. 10, 2013

(65) Prior Publication Data

US 2015/0056910 A1 Feb. 26, 2015

(30) Foreign Application Priority Data

Apr. 6, 2012 (WO) ..... PCT/JP2012/002418

(51) Int. Cl.
*F25D 17/06* (2006.01)
*F24F 7/007* (2006.01)
(Continued)

(52) U.S. Cl.
CPC ..... *F25D 17/06* (2013.01); *F04D 17/04* (2013.01); *F04D 29/30* (2013.01); *F24F 1/0018* (2013.01); *F24F 1/0025* (2013.01); *F24F 7/007* (2013.01)

(58) Field of Classification Search
CPC ..... F04D 17/04; F04D 29/30; F25D 17/06; F24F 1/0025
(Continued)

(56) References Cited

U.S. PATENT DOCUMENTS 3,673,773 A * 7/1972 Ferguson ..... A01D 34/42 415/53.1
6,692,223 B2 * 2/2004 Ikeda ..... F04D 17/04 165/122
(Continued)

FOREIGN PATENT DOCUMENTS

JP 38-17526 B1 9/1963
JP 05-079492 A 3/1993
(Continued)

OTHER PUBLICATIONS

Ikeda, JP2011-122522 A English machine translation, Jun. 23, 2011.*
(Continued)

*Primary Examiner* — Kenneth Rinehart
*Assistant Examiner* — Phillip Decker
(74) *Attorney, Agent, or Firm* — Posz Law Group, PLC

(57) ABSTRACT

A blade included in an impeller is formed so that, when viewed in a vertical cross-sectional view of the blade, a pressure surface of the blade and a suction surface of the blade opposite to the pressure surface are curved more in the direction in which the impeller rotates, in their areas farther from the axis of rotation of the impeller and closer to the exterior of the blade, and are arched so that a portion near
(Continued)

the center of the blade is most distant from a straight line connecting the inner end and the outer end of the blade, the pressure surface and the suction surface form a curved surface including at least one circular arc, and a straight portion of the blade is formed to be connected to the curved surface on its one side, and extend toward the inner end of the blade on its other side.

3 Claims, 17 Drawing Sheets

(51) Int. Cl.
*F04D 17/04* (2006.01)
*F24F 1/0018* (2019.01)
*F04D 29/30* (2006.01)
*F24F 1/0025* (2019.01)

(58) Field of Classification Search
USPC ..... 454/252
See application file for complete search history.

(56) References Cited

U.S. PATENT DOCUMENTS 6,769,876 B2 * 8/2004 Sakai ..... F01D 1/02 415/206
7,118,345 B2 * 10/2006 Wu ..... F04D 29/30 416/210 R
7,399,161 B2 * 7/2008 Kao ..... F04D 29/30 416/187
7,422,418 B2 * 9/2008 Ishijima ..... F04D 29/283 415/119
7,618,239 B2 * 11/2009 Hatsugai ..... F04D 29/666 416/185
7,815,419 B2 * 10/2010 Teraoka ..... F04D 29/283 416/178
8,029,242 B2 * 10/2011 Teraoka ..... F04D 17/04 416/223 R
8,100,664 B2 * 1/2012 Hwang ..... F04D 29/30 416/236 R
8,910,492 B2 * 12/2014 Ikeda ..... F04D 17/04 62/263
9,039,347 B2 * 5/2015 Tadokoro ..... F04D 17/04 415/53.1
9,127,681 B2 * 9/2015 Ohtsuka ..... F04D 17/04
9,157,673 B2 * 10/2015 Ikeda ..... F04D 17/04
9,206,815 B2 * 12/2015 Shiraichi ..... F04D 29/282
9,303,649 B2 * 4/2016 Ikeda ..... F24F 1/0025
9,382,913 B2 * 7/2016 Shiraichi ..... F04D 29/283
9,453,512 B2 * 9/2016 Tadokoro ..... F04D 29/30
9,759,220 B2 * 9/2017 Tadokoro ..... F04D 17/04
9,759,441 B2 * 9/2017 Tadokoro ..... F24F 7/007
9,938,979 B2 * 4/2018 Nanba ..... F04D 29/2255
2007/0212211 A1 * 9/2007 Chiyoda ..... F04D 17/04 415/53.1
2011/0033307 A1 * 2/2011 Teraoka ..... F24F 1/0007 416/228
2012/0171013 A1 * 7/2012 Ohtsuka ..... F04D 17/04 415/53.2
2012/0177477 A1 * 7/2012 Shiraichi ..... F04D 17/04 415/53.1
2013/0101405 A1 * 4/2013 Shiraichi ..... F04D 29/283 415/191
2013/0259669 A1 * 10/2013 Tadokoro ..... F04D 17/04 415/185
2014/0102676 A1 * 4/2014 Tadokoro ..... F04D 17/04 165/121
2015/0292508 A1 * 10/2015 Ikeda ..... F04D 29/283 415/208.2
2018/0238351 A1 * 8/2018 Kono ..... F04D 29/30

FOREIGN PATENT DOCUMENTS

JP 2001-263285 A 9/2001
JP 2001-280288 A 10/2001
JP 2001-323891 A 11/2001
JP 2003-028089 A 1/2003
JP 3661579 B2 4/2005
JP 2007-255426 A 10/2007
JP 2008-157568 A 7/2008
JP 2008-215120 A 9/2008
JP 2008215120 A * 9/2008
JP 2009-036138 A 2/2009
JP 2009-133271 A 6/2009
JP 2010-236437 A 10/2010
JP 2011-122522 A 6/2011
JP 2011196387 A 10/2011
JP 2012-007473 A 1/2012
JP 4896213 B2 1/2012
JP 2012180802 A * 9/2012 ..... F04D 17/04
WO 2012/002081 A1 1/2012
WO WO-2013051297 A1 * 4/2013 ..... F04D 17/04

OTHER PUBLICATIONS

Shiraichi, et al, JP 2012-180802 A English machine translation, Sep. 20, 2012.*
Office Action dated Apr. 7, 2016 in the corresponding NZ application No. 716887.
International Search Report of the International Searching Authority dated Dec. 25, 2012 for the corresponding international application No. PCT/JP2012/075780 (and English translation).
Chinese Office Action dated Jun. 2, 2016 in the corresponding CN application No. 201280073250.7 (English translation attached).
Office Action dated Oct. 28, 2016 in the corresponding CN application No. 201280073250.7 (English translation attached).
Extended European Search Report dated Jan. 27, 2016 in the corresponding EP application No. 12873807.7.
Office Action dated Mar. 27, 2019 issued in corresponding IN patent application No. 7818/CHENP/2014.

* cited by examiner

INDOOR UNIT FOR AIR-CONDITIONING APPARATUS

CROSS REFERENCE TO RELATED APPLICATIONS

This application is a U.S. national stage application of PCT/JP2012/075780 filed on Oct. 4, 2012, and is based on PCT/JP2012/002418 filed on Apr. 6, 2012, the contents of which are incorporated herein by reference.

TECHNICAL FIELD

The present invention relates to an indoor unit for an air-conditioning apparatus equipped with a cross-flow fan used as an air-sending means.

BACKGROUND

There has been proposed an air-conditioning apparatus equipped with a cross-flow fan configured so that the curved lines of an impeller form two circular arcs with different radii, in which the airflow of air passing between blades follows the blade surface more than in a single circular arc (see, for example, Patent Literature 1). In the technique described in Patent Literature 1, a curved line radius R2 of the impeller on the impeller outer circumferential side is larger than a curved line radius R1 of the impeller on the impeller inner circumferential side, so that "the blade thickness is approximately equal across the distance from the impeller inner circumferential side to the outer circumferential side", or so that "the blade thickness takes a maximum at the impeller inner circumferential end, and is smaller in areas of the blade closer to the outer circumferential side".

There has also been proposed an air-conditioning apparatus equipped with a cross-flow fan having blades with "a thickness distribution which takes a maximum thickness value on the impeller inner circumferential side of a blade, and is smaller in thickness value in areas of the blade closer to the outer circumferential side of the impeller of the blade", in which the position of the maximum bend height of the blade is specified (see, for example, Patent Literature 2). The technique described in Patent Literature 2 improves the air volume performance for the same noise level by equipping a cross-flow fan with such blades.

There has moreover been proposed an air-conditioning apparatus equipped with a cross-flow fan in which "the blade thickness is smaller in areas of the blade closer to the impeller outer circumferential side so that the inter-blade dimensions between individual blades become approximately equal on the outer circumferential side and inner circumferential side of the impeller" (see, for example, Patent Literature 3).

Again, there has been proposed an air-conditioning apparatus equipped with a cross-flow fan formed so that the thickness of a blade takes a maximum at a position 4% from the inner side of the chord of the blade, and is smaller in areas of the blade farther from the maximum thickness position of the blade and closer to the two ends of the blade (see, for example, Patent Literature 4).

There has been proposed a cross-flow fan in which the length of a blade is divided into a plurality of areas, and when the portion adjacent to a support plate is defined as a first area, the central portion of a blade is defined as a second area, and the portion between the first area and the second area is defined as a third area, the blade outlet angle on the blade outer circumferential edge is largest in the third area, is second largest in the first area, and is smallest in the second area (see, for example, Patent Literature 5).

PATENT LITERATURE

Patent Literature 1: Japanese Unexamined Patent Application Publication No. 2001-280288 (for example, p. 4, [0035], [0040], and FIG. 5)

Patent Literature 2: Japanese Unexamined Patent Application Publication No. 2001-323891 (for example, p. 2, [0016], [0018], and FIG. 5)

Patent Literature 3: Japanese Unexamined Patent Application Publication No. 5-79492 (p. 2, [0010], and FIG. 1)

Patent Literature 4: Japanese Patent No. 3661579 (p. 2, [0011], and FIG. 1)

Patent Literature 5: Japanese Patent No. 4896213 (p. 6, [0024], and FIG. 7)

With the technique described in Patent Literature 1, the blade thickness is approximately equal across the distance from the impeller inner circumferential side to the outer circumferential side, that is, the blade thickness is approximately equally small over the range from the upstream side, that is, the leading curve portion of the casing, to the downstream side that is the stabilizer side. For this reason, there is a possibility that the flow may separate on the impeller inner circumferential side.

With the technique described in Patent Literature 1, since the blade thickness takes a maximum at the impeller inner circumferential end, and is smaller in areas of the blade closer to the outer circumferential side, after a flow collides at the inner circumferential end, there is a possibility that the flow may remain separated and move to the downstream side without reattaching onto the outer circumferential surface of the impeller.

In this way, the technique described in Patent Literature 1 is problematic in that flow separation occurs, so that the effective blade arrangement range in which the air flows between the blades without disturbance in the path decreases, the blown air velocity increases, and noise becomes more serious.

With the technique described in Patent Literature 2, a thickness distribution is obtained which takes a maximum thickness value on the impeller inner circumferential side of a blade, and is smaller in thickness value in areas of the blade closer to the outer circumferential side of the impeller of the blade. For this reason, if the blade thickness takes a maximum at, for example, one position defined at the inner circumferential end (0% ratio from the inner circumferential side of the chord), after a flow collides at this inner circumferential end, there is a possibility that the flow may separate to the downstream side without reattaching onto the blade surface.

With the technique described in Patent Literature 2, even if the blade thickness takes a maximum at an arbitrary position other than the inner circumferential end, because the inner circumferential end is thin, there is a possibility that a flow may remain separated and move to the downstream side without reattaching onto the impeller surface on the side defined by the counter-rotational direction.

In this way, the technique described in Patent Literature 2 is problematic in that flow separation occurs, so that the effective inter-blade distance decreases, the blown air velocity increases, and noise becomes more serious.

With the technique described in Patent Literature 3, since the inter-blade dimensions between individual blades are approximately equal on the outer circumferential side and inner circumferential side of the impeller, the blade thickness is large correspondingly, the inter-blade distance is relatively small, and the passing air velocity is relatively high, possibly producing relatively serious noise.

With the technique described in Patent Literature 3, since the blade thickness takes a maximum at the impeller inner circumferential end, after a flow collides at the inner circumferential end, there is a possibility that the flow may separate to the downstream side without reattaching onto the blade surface.

In this way, the technique described in Patent Literature 3 is problematic in that the passing air velocity is relatively high and noise is relatively serious, and also in that the flow separates to the downstream side without reattaching onto the blade surface, so that the effective inter-blade distance decreases, the blown air velocity increases, and noise becomes more significant.

With the technique described in Patent Literature 4, the thickness of a blade takes a maximum at a position 4% from the inner side of the chord of the blade, and this means that the blade thickness takes a maximum nearly at the inner circumferential end. For this reason, after a flow collides at the inner circumferential end, there is a possibility that the flow may remain separated and move to the downstream side without reattaching onto the outer circumferential surface of the impeller.

In this way, the technique described in Patent Literature 4 is problematic in that flow separation occurs, so that the effective inter-blade distance decreases, the blown air velocity increases, and noise becomes more serious.

With the technique described in Patent Literature 5, the blade outlet angle varies in the blade longitudinal direction; the blade outlet angle is largest in the third area (between the first and second areas), is second largest in the first area (support plate adjacent portion), and is smallest in the second area (blade central portion). However, in a blade cross-sectional shape, if the blade thickness is smaller in portions of the impeller inner circumferential end farther from the maximum thickness portion, and takes too small a value, flow separation may occur.

In this way, the technique described in Patent Literature 5 is problematic in that flow separation occurs, so that the effective inter-blade distance decreases, and the blown air velocity increases, which generates more significant noise and therefore degrades efficiency.

SUMMARY

The present invention has been made in order to solve at least one of the above-described problems, and has as its object to provide an indoor unit for an air-conditioning apparatus that suppresses the production of noise.

An air-conditioning apparatus according to the present invention includes: a main body that includes an air inlet and an air outlet; a cross-flow fan that is provided inside the main body, and includes an impeller that, by rotation, draws air into the main body from the air inlet and blows the air from the air outlet; and a stabilizer that partitions a space inside the main body into an inlet-side air passage which is on an upstream side of the cross-flow fan, and an outlet-side air passage which is on a downstream side of the cross-flow fan. A blade included in the impeller is formed so that, when viewed in a vertical cross-sectional view of the blade, a pressure surface of the blade and a suction surface of the blade opposite to the pressure surface are curved more in a rotational direction, in which the impeller rotates, in their areas farther from an axis of rotation of the impeller and closer to an exterior of the blade, and are arched so that a portion near a center of the blade is most distant from a straight line connecting an inner end and an outer end of the blade, the pressure surface and the suction surface form a curved surface including at least one circular arc, a straight portion of the blade is formed to be connected to the curved surface on its one side, and extend toward the inner end of the blade on its other side, and is defined by a flat surface continuous with a surface formed by a circular arc out of the pressure surface and the suction surface, and when a diameter of a circle inscribed in the pressure surface and the suction surface is defined as a blade thickness, the blade thickness at the outer end is less than at the inner end, is larger in areas of the blade farther from the outer end, and is approximately equal in the straight portion.

An indoor unit for an air-conditioning apparatus according to the present invention has the above-described configuration, and is thus able to suppress the production of noise.

DETAILED DESCRIPTION

Embodiment 1.

Exemplary embodiments of the present invention will be described hereinafter with reference to the accompanying drawings.

Figure 1:
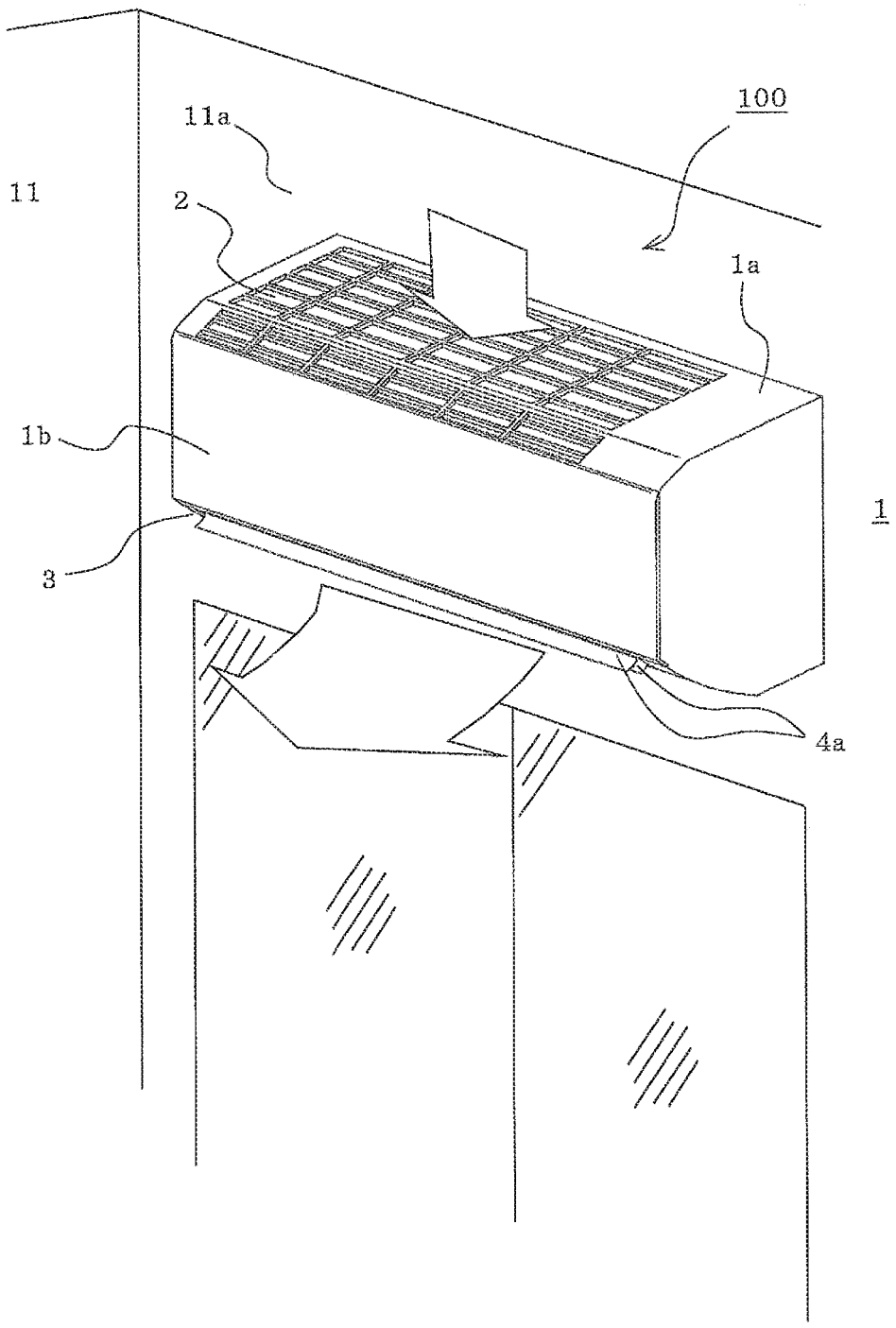
FIG. 1 is a perspective view of an indoor unit for an air-conditioning apparatus according to Embodiment 1 of the present invention, as installed or set up.
Figure 2:
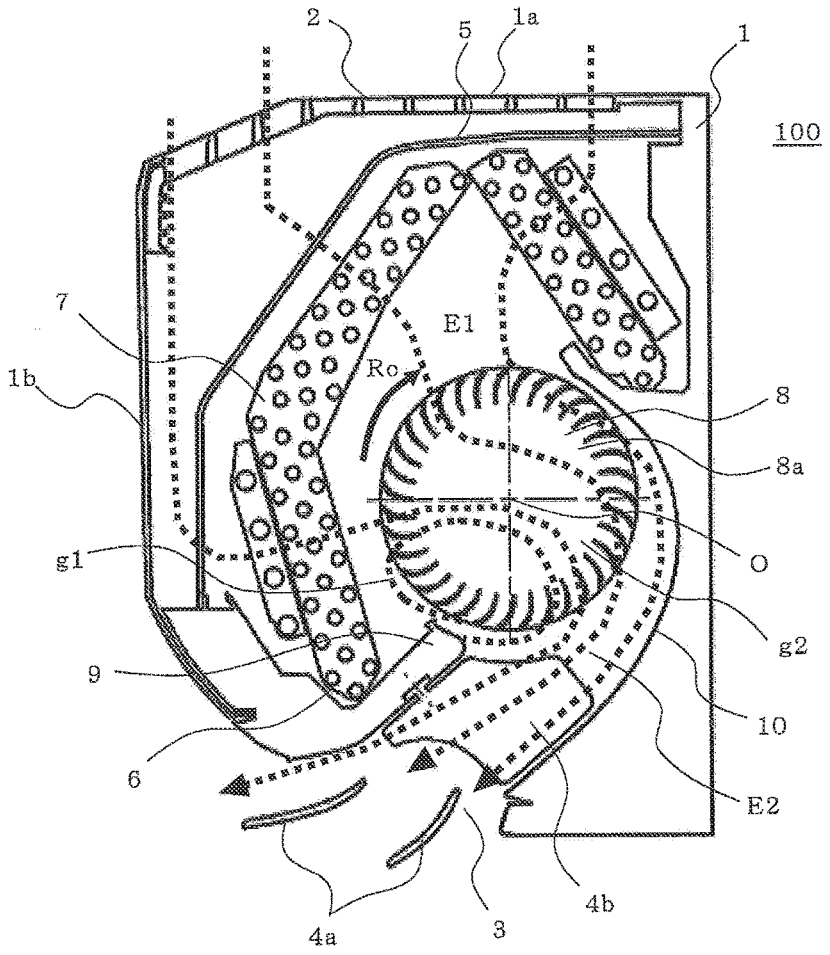
FIG. 2 is a vertical cross-sectional view of the indoor unit for an air-conditioning apparatus illustrated in FIG. 1.
Figure 3:
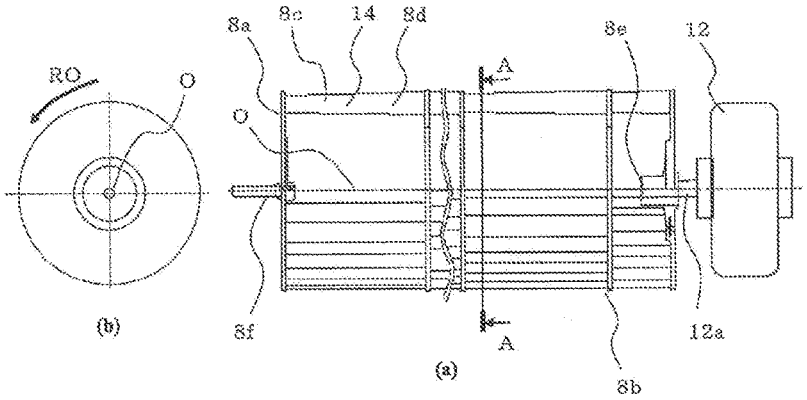
FIG. 3 shows in (a) a front view of an impeller of a cross-flow fan illustrated in FIG. 2, and in (b) a side view of the impeller of the cross-flow fan illustrated in FIG. 2.
Figure 4:
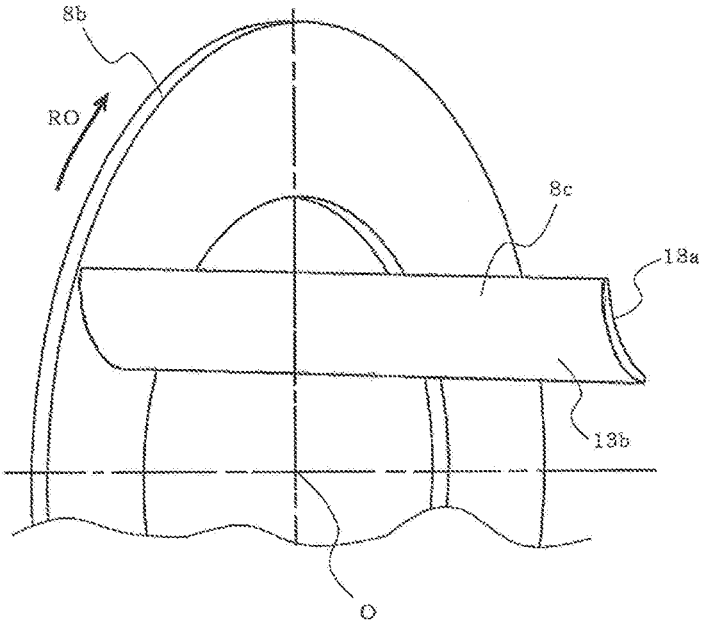
FIG. 4 is a perspective view of the impeller of the cross-flow fan, illustrated in FIG. 3, as provided with one blade.

FIG. 1 is a perspective view of an indoor unit for an air-conditioning apparatus according to Embodiment 1, as installed or set up. FIG. 2 is a vertical cross-sectional view of the indoor unit for an air-conditioning apparatus illustrated in FIG. 1. FIG. 3 shows in (a) a front view of an impeller of a cross-flow fan illustrated in FIG. 2, and in (b) a side view of the impeller of the cross-flow fan illustrated in FIG. 2. FIG. 4 is a perspective view of the impeller of the cross-flow fan, illustrated in FIG. 3, as provided with one blade.

In the indoor unit for an air-conditioning apparatus according to Embodiment 1, the blades of a cross-flow fan built into the indoor unit are improved so as to suppress the production of noise.

[Configuration of Indoor Unit 100]

As illustrated in FIG. 1, an indoor unit 100 includes a main body 1 and a front panel 1*b* provided on the front surface of the main body 1, and has its outer periphery defined by the main body 1 and the front panel 1*b*. Referring to FIG. 1, the indoor unit 100 is installed on a wall 11*a* of a room 11, which serves as an air-conditioned space. In other words, although FIG. 1 illustrates an example in which the indoor unit 100 is of the wall-mounted type, the indoor unit 100 is not limited to this, and may also be of the ceiling-mounted type or the like. In addition, the indoor unit 100 is not limited to that installed in the room 11, and may also be installed in a room of a building, a warehouse, or the like.

As illustrated in FIG. 2, an air inlet grille 2 for drawing indoor air into the indoor unit 100 is formed on a main body top portion 1*a* that constitutes the top part of the main body 1. An air outlet 3 for supplying conditioned air indoors is formed on the bottom of the main body 1. A guide wall 10 is also formed which guides air blown from a cross-flow fan 8 (to be described later) to the air outlet 3.

As illustrated in FIG. 2, the main body 1 includes a filter 5 that removes particles such as dust in the air drawn in from the air inlet grille 2, a heat exchanger 7 that transfers heating energy or cooling energy of a refrigerant to the air to generate conditioned air, a stabilizer 9 that provides a partition between an inlet-side air passage E1 and an outlet-side air passage E2, a cross-flow fan 8 that draws in air from the air inlet grille 2 and blows the air from the air outlet 3, and vertical air vanes 4*a* and horizontal air vanes 4*b* that adjust the direction of air blown from the cross-flow fan 8.

The air inlet grille 2 is an opening that takes in indoor air forcibly drawn in by the cross-flow fan 8 into the indoor unit 100. The air inlet grille 2 opens on the top face of the main body 1. Note that although FIGS. 1 and 2 illustrate an example in which the air inlet grille 2 opens only on the top face of the main body 1, obviously it may also open on the front panel 1*b*. Additionally, the shape of the air inlet grille 2 is not particularly limited.

The air outlet 3 is an opening that passes air, which is drawn in from the air inlet grille 2 and has passed through the heat exchanger 7, in supplying it to the indoor area. The air outlet 3 opens on the front panel 1*b*. Note that the shape of the air outlet 3 is not particularly limited.

The guide wall 10, together with the bottom face of the stabilizer 9, constitutes the outlet-side air passage E2. The guide wall 10 forms an oblique face that slopes from the cross-flow fan 8 toward the air outlet 3. The shape of this oblique face is preferably formed to correspond to "a part" of, for example, a spiral pattern.

The filter 5 has, for example, a meshed structure and removes particles such as dust in the air drawn in from the air inlet grille 2. The filter 5 is provided in the air passage from the air inlet grille 2 to the air outlet 3 (the central part of the interior of the main body 1), on the downstream side of the air inlet grille 2 and on the upstream side of the heat exchanger 7.

The heat exchanger 7 (indoor heat exchanger) functions as an evaporator that cools the air during a cooling operation, and functions as a condenser (radiator) that heats the air during a heating operation. The heat exchanger 7 is provided in the air passage from the air inlet grille 2 to the air outlet 3 (the central part of the interior of the main body 1), on the downstream side of the filter 5 and on the upstream side of the cross-flow fan 8. Note that although the heat exchanger 7 is formed in a shape that surrounds the front face and the top face of the cross-flow fan 8 in FIG. 2, the shape of the heat exchanger 7 is not particularly limited.

Note that the heat exchanger 7 is assumed to be connected to an outdoor unit including, for example, a compressor, an outdoor heat exchanger, and an expansion device to constitute a refrigeration cycle. In addition, the heat exchanger 7 may be implemented using a cross-fin, fin-and-tube heat exchanger including, for example, heat transfer pipes and a large number of fins.

The stabilizer 9 provides a partition between the inlet-side air passage E1 and the outlet-side air passage E2.

The stabilizer 9 is provided on the bottom of the heat exchanger 7, as illustrated in FIG. 2. The inlet-side air passage E1 is provided on the top side of the stabilizer 9, while the outlet-side air passage E2 is provided on its bottom side. The stabilizer 9 includes a drain pan 6 that temporarily accumulates condensation water adhering to the heat exchanger 7.

The cross-flow fan 8 draws in indoor air from the air inlet grille 2, and blows conditioned air from the air outlet 3. The cross-flow fan 8 is provided in the air passage from the air inlet grille 2 to the air outlet 3 (the central part of the interior of the main body 1), on the downstream side of the heat exchanger 7 and on the upstream side of the air outlet 3.

As illustrated in FIG. 3, the cross-flow fan 8 includes an impeller 8*a* made of a thermoplastic resin such as ABS resin, a motor 12 for rotating the impeller 8*a*, and a motor shaft 12*a* that transmits the rotation of the motor 12 to the impeller 8*a*.

The impeller 8*a* is made of a thermoplastic resin such as ABS resin, and is configured to, by rotation, draw in indoor air from the air inlet grille 2, and deliver it to the air outlet 3 as conditioned air.

The impeller 8*a* includes a plurality of joined impeller bodies 8*d* that include a plurality of blades 8*c* and a plurality of rings 8*b* fixed to the tip portions of the plurality of blades 8*c*. In other words, a plurality of blades 8*c* extending approximately perpendicularly from the side face of the outer circumferential portion of a disk-shaped ring 8*b* are connected at a predetermined interval in the circumferential direction of the ring 8*b* to form an impeller unit 8*d*, and such a plurality of impeller bodies 8*d* are welded together to form an integrated impeller 8*a*.

The impeller 8*a* includes a fan boss 8*e* protruding inwards into the impeller 8*a*, and a fan shaft 8*f* to which the motor shaft 12*a* is fixed by screws or the like. In addition, the impeller 8*a* is supported on its one side by the motor shaft 12*a* via the fan boss 8*e*, and is supported on its other side by the fan shaft 8*f*. With this arrangement, the impeller 8*a* is able to, while being supported at its two ends, rotate in a rotational direction RO about an axis of rotation center O of the impeller 8*a*, draw in indoor air from the air inlet grille 2, and deliver conditioned air to the air outlet 3.

Note that the impeller 8*a* will be described in more detail with reference to FIGS. 4 to 7.

The vertical air vanes 4*a* adjust vertical movement of air blown from the cross-flow fan 8, while the horizontal air vanes 4*b* adjust horizontal movement of the air blown from the cross-flow fan 8.

The vertical air vanes 4*a* are provided more downstream than the horizontal air vanes 4*b*. As illustrated in FIG. 2, the upper parts of the vertical air vanes 4*a* are rotatably attached to the guide wall 10.

The horizontal air vanes 4*b* are provided more upstream than the vertical air vanes 4*a*. As illustrated in FIG. 1, the two ends of the horizontal air vanes 4*b* are rotatably attached to the portion of the main body 1 that constitutes the air outlet 3.

Figure 5:
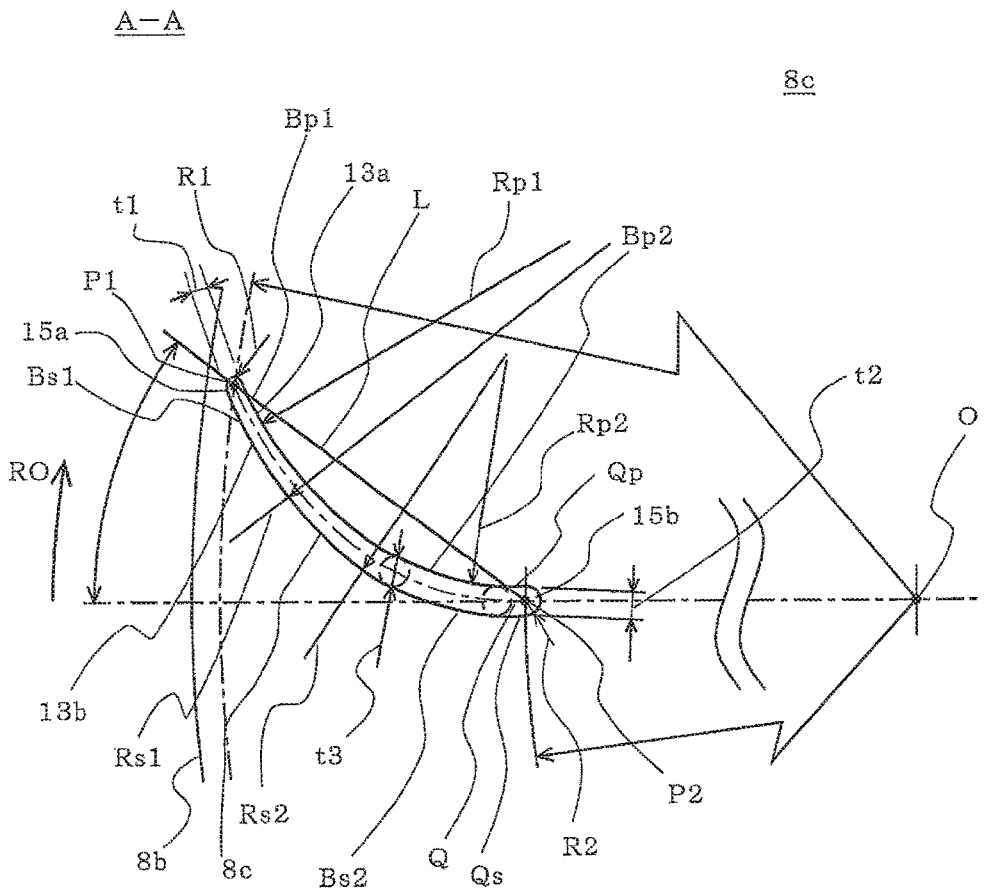
FIG. 5 is a cross-sectional view of the blade of the cross-flow fan taken along a line A-A in FIG. 3.
Figure 6:
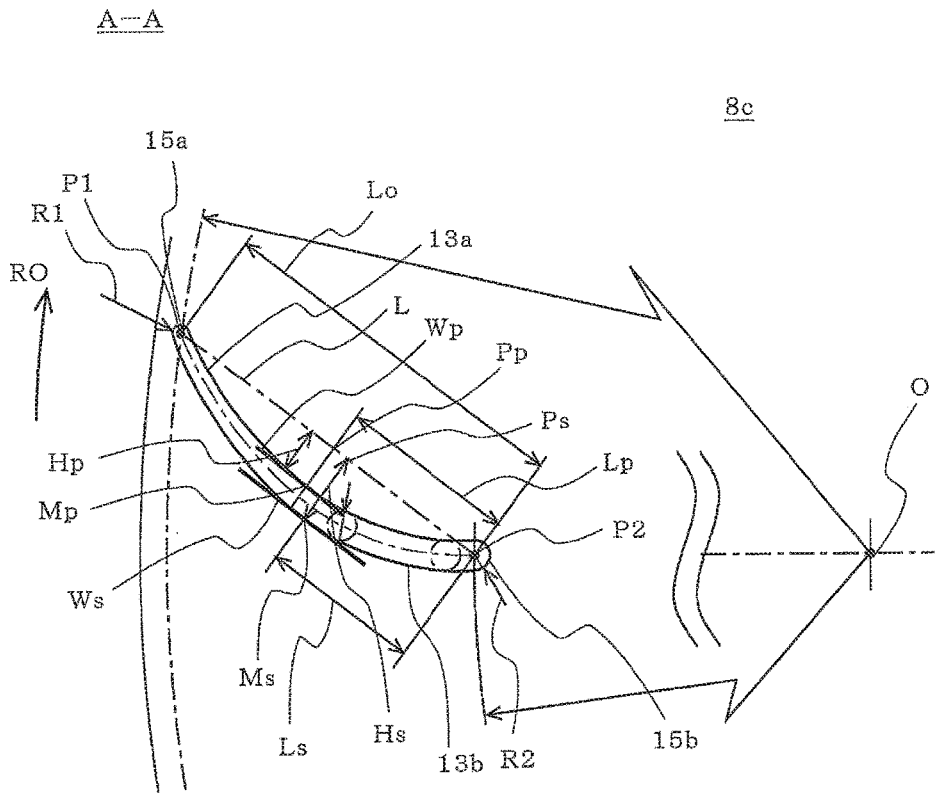
FIG. 6 is a cross-sectional view of the blade of the cross-flow fan taken along the line A-A in FIG. 3.

FIG. 4 is a perspective view of the impeller 8*a* of the cross-flow fan 8, illustrated in FIG. 3, as provided with one blade 8*c*. FIGS. 5 and 6 are cross-sectional views of the blade of the cross-flow fan taken along the line A-A in FIG. 3. Note that for the sake of convenience, FIG. 4 illustrates a state in which only one blade 8*c* is provided.

As illustrated in FIGS. 5 and 6, both the end of the blade 8*c* on the outer circumferential end (outer end) 15*a* and the end on the inner circumferential end (inner end) 15*b* are formed in circular arcs. In addition, in the blade 8*c*, the outer circumferential end 15*a* is slanted forward in the impeller rotational direction RO relative to the inner circumferential end 15*b*. In other words, when viewed in a vertical cross-sectional view of the blade 8*c*, the pressure surface 13*a* and the suction surface 13*b* of the blade 8*c* are curved more in the impeller rotational direction RO in their areas farther from the axis of rotation O of the impeller 8*a* and closer to the exterior of the blade 8*c*. Additionally, the blade 8*c* is arched so that the portion near the center of the blade 8*c* is most distant from a straight line connecting the outer circumferential end 15*a* and the inner circumferential end 15*b*.

Let P1 be the center of a circle corresponding to the circular arc in which the outer circumferential end 15*a* is formed (to be also referred to as the circular arc center P1 hereinafter), and P2 be the center of a circle corresponding to the circular arc in which the inner circumferential end 15*b* is formed (to be also referred to as the circular arc center P2 hereinafter). Also, when a line segment connecting the circular arc centers P1 and P2 is defined as a chord line L, the length of the chord line L becomes Lo (to be also referred to as the chord length Lo hereinafter), as illustrated in FIG. 6.

The blade 8*c* includes a pressure surface 13*a*, which is the surface on the side defined by the rotational direction RO in which the impeller 8*a* rotates, and a suction surface 13*b*, which is on the side opposite to that defined by the rotational direction RO in which the impeller 8*a* rotates. In the blade 8*c*, the portion near the center of the chord line L forms a depression curved more in the direction from the pressure surface 13*a* toward the suction surface 13*b*.

In addition, in the blade 8*c*, the radius of the circle corresponding to the circular arc on the side of the pressure surface 13*a* differs between the outer circumferential side of the impeller 8*a* and the inner circumferential side of the impeller 8*a*.

In other words, as illustrated in FIG. 5, the pressure surface 13*a* of the blade 8*c* forms a curved surface which is defined by multiple circular arcs, and includes an outer circumferential curved surface Bp1 having a radius (circular arc radius) Rp1 corresponding to the circular arc on the outer circumferential side of the impeller 8*a*, and an inner circumferential curved surface Bp2 having a radius (circular arc radius) Rp2 corresponding to the circular arc on the inner circumferential side of the impeller 8*a*.

Furthermore, the pressure surface 13*a* of the blade 8*c* includes a flat surface Qp connected to the inner circumferential end out of the ends of the inner circumferential curved surface Bp2, and having a planar shape.

In this way, the pressure surface 13*a* of the blade 8*c* includes a continuous arrangement of the outer circumferential curved surface Bp1, inner circumferential curved surface Bp2, and flat surface Qp. Note that when viewed in a vertical cross-sectional view of the blade 8*c*, the straight line constituting the flat surface Qp is a tangent at the point where the circular arc constituting the inner circumferential curved surface Bp2 is connected.

On the other hand, the suction surface 13*b* of the blade 8*c* corresponds in surface configuration to the pressure surface 13*a* of the blade 8*c*. Specifically, the suction surface 13*b* of the blade 8*c* includes an outer circumferential curved surface Bs1 having a radius (circular arc radius) Rs1 corresponding to the circular arc on the outer circumferential side of the impeller 8*a*, and an inner circumferential curved surface Bs2 having a radius (circular arc radius) Rs2 corresponding to the circular arc on the inner circumferential side of the impeller 8*a*. Furthermore, the suction surface 13*b* of the blade 8*c* includes a flat surface Qs connected to the inner circumferential end out of the ends of the inner circumferential curved surface Bs2, and having a planar shape.

In this way, the suction surface 13*b* of the blade 8*c* includes a continuous arrangement of the outer circumferential curved surface Bs1, inner circumferential curved surface Bs2, and flat surface Qs. Note that when viewed in a vertical cross-sectional view of the blade 8*c*, the straight line constituting the flat surface Qs is a tangent at the point where the circular arc constituting the inner circumferential curved surface Bs2 is connected.

In this case, the diameter of a circle inscribed in the blade surface of the blade 8*c* when viewed in a vertical cross-sectional view of the blade 8*c* is defined as a blade thickness t. Then, as illustrated in FIGS. 5 and 6, the blade thickness t1 of the outer circumferential end 15*a* is smaller than the blade thickness t2 of the inner circumferential end 15*b*. Note that the blade thickness t1 is double the radius R1 of the circle constituting the circular arc of the outer circumferential end 15*a*, while the blade thickness t2 is double the radius R2 of the circle constituting the circular arc of the inner circumferential end 15*b*.

In other words, the blade 8*c* is formed so that, when the diameter of a circle inscribed in the pressure surface 13*a* and the suction surface 13*b* of the blade 8*c* is defined as a blade thickness, the blade thickness is smaller at the outer circumferential end 15*a* than at the inner circumferential end 15*b*, is larger in areas of the blade 8*c* farther from the outer circumferential end 15*a* and closer to the center of the blade 8*c*, takes a maximum at a predetermined position near the center of the blade 8*c*, is smaller in areas of the blade 8*c* closer to the interior of the blade, and is approximately equal in a straight portion Q.

More specifically, in the range of the outer circumferential curved surfaces and inner circumferential curved surfaces Bp1, Bp2, Bs1, and Bs2 formed between the pressure surface 13*a* and the suction surface 13*b*, excluding the outer circumferential end 15*a* and the inner circumferential end 15*b*, the blade thickness t of the blade 8*c* is larger in areas of the blade 8*c* farther from the outer circumferential end 15*a* and closer to the center of the blade 8*c*, is equal to a maximum thickness t3 at a predetermined position near the center of the chord line L, and is smaller in areas of the blade 8*c* closer to the inner circumferential end 15*b*. In addition, in the range of the straight portion Q, that is, the range between the flat surfaces Qp and Qs, the blade thickness t is equal to an approximately constant inner circumferential end thickness t2.

The portion of the blade 8*c* whose surfaces are the flat surfaces Qp and Qs of the inner circumferential end 15*b* will be referred to as the straight portion Q hereinafter. In other words, the suction surface 13*b* of the blade 8*c* is formed by multiple circular arcs and the straight portion Q across the distance from the outer circumferential side to the inner circumferential side of the impeller.

(1) For this reason, when the blade 8*c* passes through the inlet-side air passage E1, a flow present on the blade surface that is about to separate on the outer circumferential curved surface Bs1 will, in turn, reattach onto the adjacent inner circumferential curved surface Bs2 having a radius different from that of the outer circumferential curved surface Bs1.

(2) Also, since the blade 8*c* includes a flat surface Qs and a negative pressure is generated, even a flow that is about to separate will reattach onto the inner circumferential curved surface Bs2.

(3) Also, since the blade thickness t is larger on the impeller inner circumferential side than on the impeller outer circumferential side, the distance between adjacent blades 8*c* is reduced.

(4) Furthermore, since the flat surface Qs is flat, the blade thickness t has no steep positive gradient toward the impeller outer circumference, unlike in the case of a curved surface, and the frictional resistance can thus be kept low.

Likewise, the pressure surface 13*a* of the blade 8*c* is also formed by multiple circular arcs and a straight portion (flat surface) in areas of the blade 8*c* across the distance from the outer circumferential side to the inner circumferential side of the impeller.

(5) For this reason, when the air flows from the outer circumferential curved surface Bp1 to the inner circumferential curved surface Bp2 having a circular arc radius different from that of the outer circumferential curved surface Bp1, the flow gradually accelerates, generating a pressure gradient on the suction surface 13*b*. This suppresses flow separation so as not to produce abnormal fluid noise.

(6) Also, the flat surface Qp on the downstream side is a tangent to the inner circumferential curved surface Bs2. In other words, since the blade 8*c* includes the flat surface Qp on the downstream side, the shape of the blade 8*c* is curved at a predetermined angle with respect to the rotational direction RO. For this reason, unlike in the case of the absence of a straight surface (flat surface Qp), even if the blade thickness t2 of the inner circumferential end 15*b* is large, the flow can be guided to the suction surface 13*b*, and trailing vortices can be reduced when the air flows into the impeller from the inner circumferential end 15*b*.

The blade 8*c* is thick at the inner circumferential end 15*b*, making separation difficult in a variety of inflow directions in the outlet-side air passage E2.

(8) Also, the blade 8*c* has a maximum thickness near the chord center, which is on the downstream side of the flat surface Qs. For this reason, when the flow is about to separate after passing through the flat surface Qs, the blade thickness t is larger in areas of the blade 8*c* closer to the approximate chord center on the inner circumferential curved surface Bs2. For this reason, the flow stays to follow the surface, and flow separation can be suppressed.

(9) Furthermore, since the blade 8*c* includes an inner circumferential curved surface Bp2 which is on the downstream side of the inner circumferential curved surface Bs2 and has a circular arc radius different from that of the inner circumferential curved surface Bs2, flow separation is suppressed, the effective outlet-side air passage from the impeller can be enlarged, potentially reducing and equalizing the blown air velocity, and the load torque on the blade surface can be decreased. As a result, flow separation from the blade surface on the inlet side and the outlet side of the impeller can be suppressed, potentially lowering noise, and the power consumption of the fan motor can be decreased. In other words, an indoor unit 100 equipped with a quiet, energy-saving cross-flow fan 8 can be obtained.

<Modification 1 of Blade 8*c*>

The blade 8*c* is desirably formed so that the circular arc radii Rp1, Rp2, Rs1, and Rs2 satisfy Rs1>Rp1>Rs2>Rp2.

In this case, in the outlet-side air passage E2, the blade 8*c* exhibits the following advantageous effects.

(10) On the suction surface 13*b*, the circular arc radius Rs1 of the outer circumferential curved surface Bs1 is greater than the circular arc radius Rs2 of the inner circumferential curved surface Bs2, forming a comparatively flat circular arc with a small curvature. For this reason, in the outlet-side air passage E2, the flow stays to follow the outer circumferential curved surface Bs1 to the vicinity of the outer circumferential end 15*a*, and trailing vortices can be made smaller.

On the pressure surface 13*a*, the circular arc radius Rp1 of the outer circumferential curved surface Bp1 is greater than the circular arc radius Rp2 of the inner circumferential curved surface Bp2, forming a comparatively flat circular arc with a small curvature. For this reason, the flow will be smooth without concentrating on the pressure surface 13*a*, and thus frictional loss can be decreased.

On the other hand, in the inlet-side air passage E1, the blade 8*c* exhibits the following advantageous effects.

(11) Since the outer circumferential curved surface Bs1 is a comparatively flat circular arc with a small curvature, the flow does not change in direction suddenly. For this reason, the flow stays to follow the suction surface 13*b* without separation.

As a result of (10) and (11), flow separation from the blade surface on the inlet side and the outlet side of the impeller can be suppressed, potentially lowering noise, and the power consumption of the fan motor can be decreased. In other words, an indoor unit 100 equipped with a quiet, energy-saving cross-flow fan 8 can be obtained.

<Modification 2 of Blade 8*c*>

As illustrated in FIG. 6, the point of contact between the pressure surface 13*a* and a parallel line Wp tangent to the pressure surface 13*a* and parallel to the chord line L is defined as a maximum bend position Mp, and the point of contact between the suction surface 13*b* and a parallel line Ws tangent to the suction surface 13*b* and parallel to the chord line Ls is defined as a maximum bend position Ms.

Also, the intersection point between the chord line L and a normal which is dropped from the chord line L and passes through the maximum bend position Mp is defined as a maximum bend chord point Pp, and the intersection point between the chord line L and a normal which is dropped from the chord line L and passes through the maximum bend position Ms is defined as a maximum bend chord point Ps.

Moreover, the distance between the circular arc center P2 and the maximum bend chord point Pp is defined as a chord maximum bend length Lp, and the distance between the circular arc center P2 and the maximum bend chord point Ps is defined as a chord maximum bend length Ls.

Again, the length of a line segment between the maximum bend position Mp and the maximum bend chord point Pp is defined as a maximum bend height Hp, and the length of a line segment between the maximum bend position Ms and the maximum bend chord point Ps is defined as a maximum bend height Hs.

In this case, noise can be reduced by configuring the ratios Lp/Lo and Ls/Lo of the chord maximum bend lengths Lp and Ls to the chord length Lo as follows.

Figure 7:
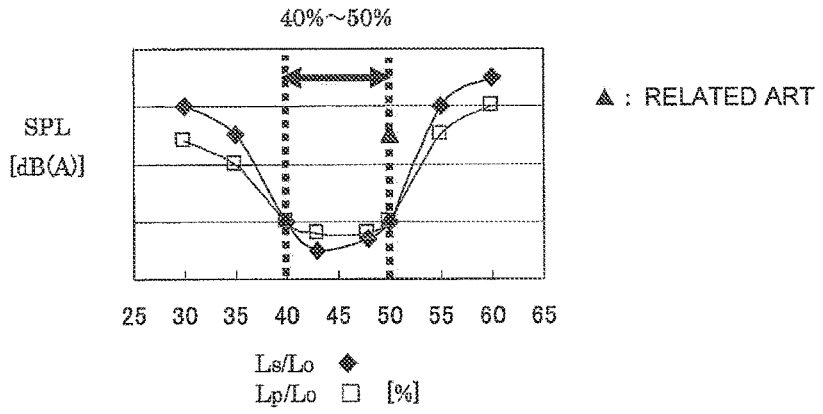
FIG. 7 is a diagram for explaining the relationship between the ratios Lp/Lo and Ls/Lo of the chord maximum bend lengths Lp and Ls to the chord length Lo, and the noise level SPL.

FIG. 7 is a diagram for explaining the relationship between the ratios Lp/Lo and Ls/Lo of the chord maximum bend lengths Lp and Ls to the chord length Lo, and the noise level SPL. Noise level SPL in the drawings is expressed in units of A-weighted decibels.

If the chord maximum bend length is too far to the outer circumferential side, the flat area of the inner circumferential curved surface Bs2 is large. In contrast, if the chord maximum bend length is too far to the inner circumferential side, the flat area of the outer circumferential curved surface Bs1 is large. Furthermore, the inner circumferential curved surface Bs2 is overly bent. In this way, if a "flat area" of the blade 8*c* is large, or if the blade 8*c* is "overly bent", separation readily occurs in the outlet-side air passage E2, and noise becomes more serious.

To overcome this, in Embodiment 1, the blade 8*c* is formed so as to have maximum bend positions in an optimal range.

As illustrated in FIG. 7, when Ls/Lo and Lp/Lo are less than 40% and the maximum bend position is on the impeller inner circumferential side, this means that the inner circumferential curved surfaces Bs2 and Bp2 of the blade 8*c* have a small circular arc radius. Moreover, when the inner circumferential curved surfaces Bs2 and Bp2 of the blade 8*c* have a small circular arc radius, this means that the bend is large, and the blade 8*c* is curved sharply. For this reason, in the outlet-side air passage E2, a flow passing through the inner circumferential end 15*b* and the flat surface Qs and the flat surface Qp will be unable to follow the inner circumferential curved surfaces Bs2 and Bp2 and separate, thereby producing pressure variations.

On the other hand, when Ls/Lo and Lp/Lo are greater than 50% and the maximum bend position is on the impeller outer circumferential side, this means that the outer circumferential curved surfaces Bs1 and Bp1 of the blade 8*c* have a large circular arc radius. Moreover, when the outer circumferential curved surfaces Bs1 and Bp1 of the blade 8*c* have a large circular arc radius, this means that the blade 8*c* has a small bend. For this reason, flows separate from the outer circumferential curved surfaces Bs1 and Bp1 of the blade 8*c*, and trailing vortices increase.

Additionally, even if Lp/Lo and Ls/Lo fall within the range of 40% to 50%, if Ls/Lo>Lp/Lo, the maximum bend position of the suction surface 13*b* is more to the outer circumferential side than the pressure surface 13*a*, and the spacing between adjacent blades 8*c* varies across the distance from the inner circumferential end 15*b* to the outer circumferential end 15*a*, thereby producing pressure variations.

To overcome this, in Embodiment 1, by forming the blade 8*c* so as to satisfy 40%≤Ls/Lo<Lp/Lo≤50%, flow separation from the blade surface on the inlet side and the outlet side of the impeller can be suppressed, potentially lowering noise, and the power consumption of the fan motor can be decreased. In other words, an indoor unit 100 equipped with a quiet, energy-saving cross-flow fan 8 can be obtained.

<Modification 3 of Blade 8*c*>

Figure 8:
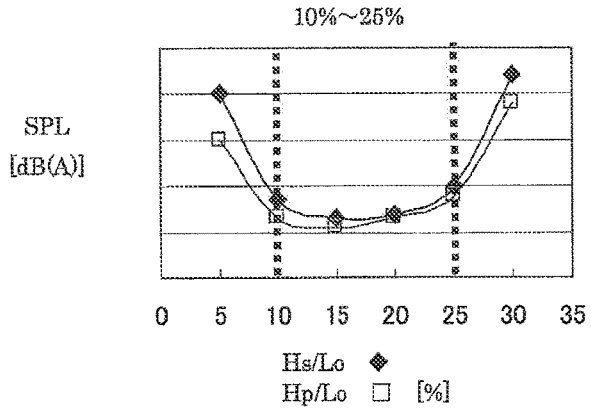
FIG. 8 is a diagram for explaining the relationship between the ratios of the maximum bend heights Hp and Hs to the chord length Lo, and the noise level SPL.

FIG. 8 is a diagram for explaining the relationship between the ratios of the maximum bend heights Hp and Hs to the chord length Lo and the noise level SPL.

If the maximum bend heights Hp and Hs are too large, the curved surface circular arc radii are small and the bend is large; otherwise, if the maximum bend heights Hp and Hs are too small, the curved surface circular arc radii are large and the bend is too small. Also, in these cases, the spacing between adjacent blades 8*c* is too wide to control flows, producing separation vortices on the blade surface and producing abnormal fluid noise. Otherwise, if this spacing is too narrow, the air velocity is relatively high, and the noise value exhibits relatively significant noise.

To overcome this, in Embodiment 1, the blade 8*c* is formed so as to have maximum bend heights in an optimal range.

Since Hp and Hs are the maximum bend heights of the pressure surface 13*a* and the suction surface 13*b*, respectively, a relation Hs>Hp holds.

As illustrated in FIG. 8, if Hs/Lo and Hp/Lo are less than 10%, the curved surface circular arc radii are large and the bend is too small, so that the spacing between adjacent blades 8*c* is too wide to control flows, producing separation vortices on the blade surface and producing abnormal fluid noise. Ultimately, the noise value exhibits a sudden shift to more serious noise.

On the other hand, if Hs/Lo and Hp/Lo are greater than 25%, the spacing between adjacent blades is too narrow and the air velocity is relatively high, and the noise value shows a sudden shift to more serious noise.

To surmount this, in Embodiment 1, by forming the blade 8*c* so as to satisfy 25%≥Hs/Lo>Hp/Lo≥10%, flow separation from the blade surface on the inlet side and the outlet side of the impeller can be suppressed, potentially lowering noise, and the power consumption of the fan motor can be decreased. In other words, an indoor unit 100 equipped with a quiet, energy-saving cross-flow fan 8 can be obtained.

<Modification 4 of Blade 8*c*>

Figure 9:
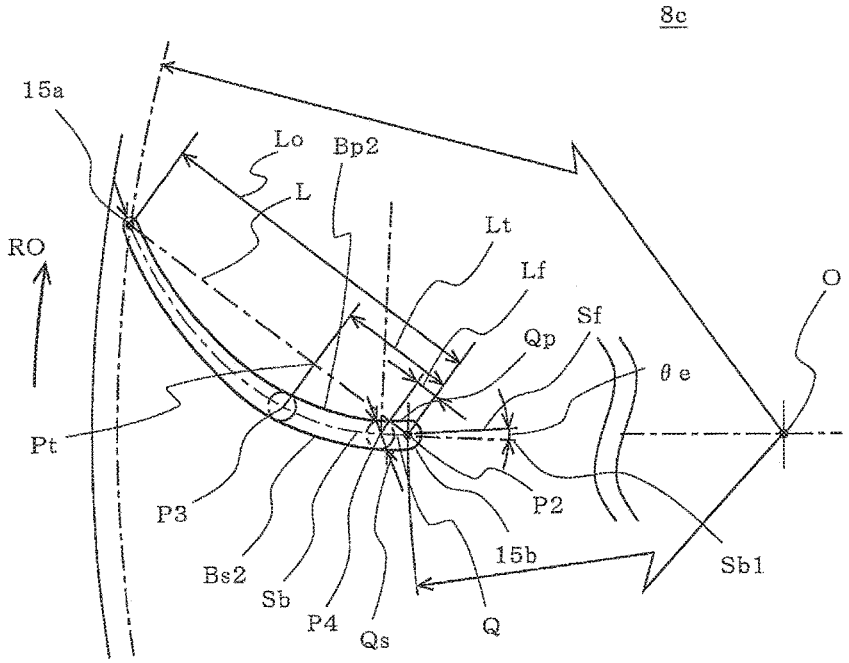
FIG. 9 is a cross-sectional view taken along the line A-A for explaining an exemplary modification of the blade of the cross-flow fan shown in FIG. 3.
Figure 10:
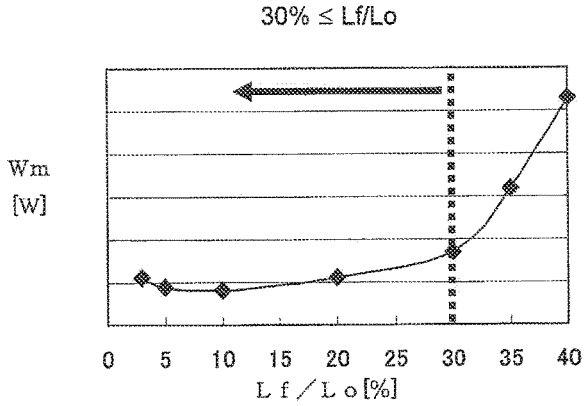
FIG. 10 is a diagram for explaining the relationship between Lf/Lo and the fan motor input Wm.
Figure 11:
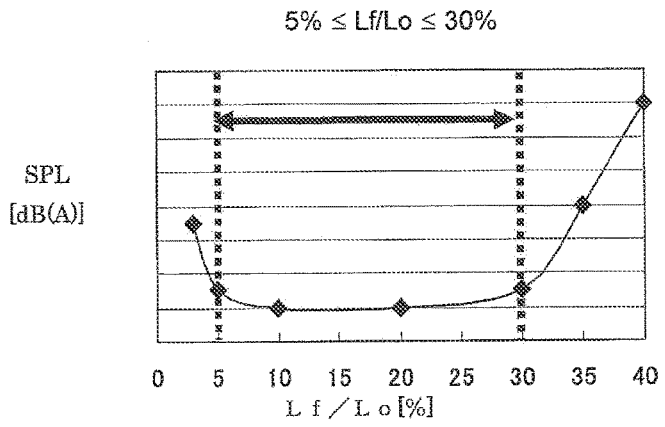
FIG. 11 is a diagram for explaining the relationship between Lf/Lo and the noise level SPL.

FIG. 9 is a cross-sectional view for explaining Modifications 4 to 6 of the blade 8*c* of the cross-flow fan 8 shown in FIG. 3. FIG. 10 is a diagram for explaining the relationship between Lf/Lo and the fan motor input Wm. FIG. 11 is a diagram for explaining the relationship between Lf/Lo and the noise level SPL.

As illustrated in FIG. 9, let P4 be the center of an inscribed circle drawn so as to be in contact with the connection position between the inner circumferential curved surface Bp2 and the flat surface Qp (first connection position) as well as the connection position between the inner circumferential curved surface Bs2 and the flat surface Qs (second connection position). The centerline of the blade 8*c* which is more to the outer circumferential side of the blade 8*c* than the straight portion Q, and passes between the inner circumferential curved surface Bp2 and the inner circumferential curved surface Bs2 is defined as a thickness centerline Sb.

Also, a straight line passing through the center P4 and the circular arc center P2 is defined as an extension line Sf. The tangent to the thickness centerline Sb at the center P4 is defined as a tangent Sb1. The angle that the tangent Sb1 and the extension line Sf make with each other is defined as an angle of bend θe.

Furthermore, the distance between a normal which is dropped from the chord line L and passes through the circular arc center P2, and a normal which is dropped from the chord line L and passes through the center P4 is defined as a straight portion chord length Lf. Let P3 be the center of a circle inscribed in the maximum thickness portion of the blade. The distance between a normal which is dropped from the chord line L and passes through the center P3, and a normal which is dropped from the chord line L and passes through the circular arc center P2 is defined as a maximum thickness portion length Lt.

If the straight portion chord length Lf of the straight portion Q of the inner circumferential end 15*b* of the blade 8*c* is too large with respect to the chord length Lo, the circular arc radii of the outer circumferential curved surfaces Bp1 and Bs1 on the outer circumferential side as well as the inner circumferential curved surfaces Bp2 and Bs2 more to the inner circumferential side than the straight portion Q are small accordingly, and the bend is large. For this reason, flows tend to separate, loss increases, the fan motor input increases, the distance between blades 8*c* varies extremely from the inner circumferential side to the outer circumferential side, and pressure variations are produced, leading to more serious noise.

In contrast, if the straight portion chord length Lf of the straight portion Q is too small with respect to the chord length Lo, a flow formed on the curved surface immediately collides at the inner circumferential end 15*b*, and afterwards, since no negative pressure is produced on the suction surface 13*b*, the flow separates without reattaching, and noise becomes more serious. Particularly, such a phenomenon noticeably occurs when dust accumulates in the filter 5 and the airflow resistance increases.

As illustrated in FIG. 10, if Lf/Lo is 30% or less, the change in the fan motor input Wm is small, and the noise level increases very little upon changes in shape. Also, as illustrated in FIG. 11, if Lf/Lo is 5% or more and 30% or less, the noise variation is small, and the noise level increases very little upon changes in shape.

Consequently, by forming the blade 8*c* so as to satisfy 30% Lf/Lo 5%, flow separation from the blade surface on the inlet side and the outlet side of the impeller can be suppressed, potentially lowering noise, and the power consumption of the fan motor can be decreased. In other words, an indoor unit 100 equipped with a quiet, energy-saving cross-flow fan 8 can be obtained.

<Modification 5 of Blade 8*c*>

Figure 12:
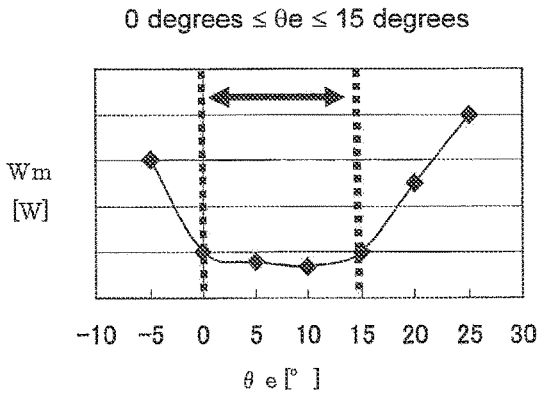
FIG. 12 is a diagram for explaining the relationship between the angle of bend θe and the fan motor input Wm [W].

FIG. 12 is a diagram for explaining the relationship between the angle of bend θe and the fan motor input Wm [W].

When the blade straight portion Q formed by the flat surfaces Qs and Qp which are the surfaces of the straight portion Q formed on the inner circumferential side of the impeller is tangent to the part formed by multiple circular arcs on the outer circumferential side of the impeller, or is curved in the impeller rotational direction to direct the flows more to the suction surface 13*b* than in the case of the absence of a straight surface, trailing vortices produced when the air flows into the impeller from the inner circumferential end 15*b* can be reduced, even when the blade thickness t2 of the inner circumferential end 15*b* is large. Note, however, that if the angle of bend is too large, the trailing vortex width expands, or much separation is produced at the inner circumferential end 15*b* in the outlet-side air passage E2, and this may lead to degradation in efficiency, and an increase in fan motor input.

To surmount this, in Embodiment 1, the blade 8*c* is formed so as to have an angle of bend in an optimal range.

As illustrated in FIG. 12, if the angle of bend θe is negative, that is, the blade 8*c* is bent in the counter-rotational direction, in the outlet-side air passage E2, a flow collides with the flat surface Qp on the pressure surface side, separates from the flat surface Qs on the suction surface side, and the flow stalls.

On the other hand, if the angle of bend θe is larger than 15 degrees, in the inlet-side air passage E1, the flow is bent sharply on the flat surface Qp that forms the surface of the straight portion Q on the pressure surface side, and the flow becomes concentrated and gains velocity. Furthermore, the flow separates from the flat surface Qs that forms the surface of the straight portion Q on the suction surface side, trailing vortices are released over a wide range, and loss increases.

To overcome this, in Embodiment 1, by forming the blade 8*c* so as to satisfy 0 degrees≤θe≤15 degrees, flow separation from the blade surface on the inlet side and the outlet side of the impeller can be suppressed, potentially lowering noise, and the power consumption of the fan motor can be decreased. In other words, an indoor unit 100 equipped with a quiet, energy-saving cross-flow fan 8 can be obtained.

<Modification 6 of Blade 8*c*>

Figure 13:
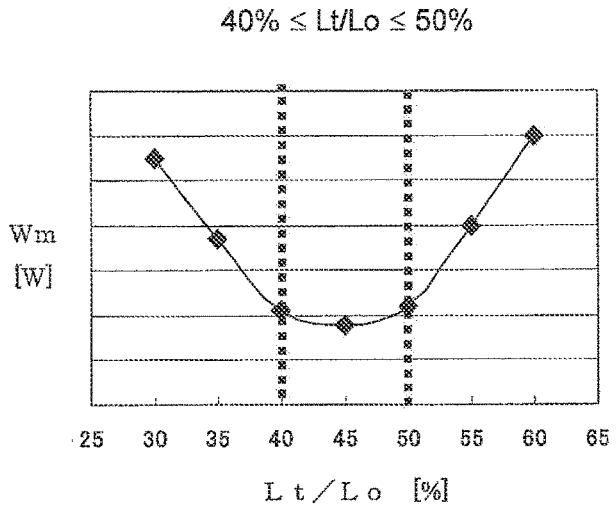
FIG. 13 is a diagram for explaining a change in fan motor input with respect to Lt/Lo.

FIG. 13 is a diagram for explaining a change in fan motor input with respect to Lt/Lo.

If the maximum thickness portion of the blade 8*c* is more to the outer circumferential side of the impeller than the midpoint of the chord line L (that is, if Lt/Lo is greater than 50%), there is a narrower inter-blade distance, as expressed by the diameter of the inscribed circle drawn so as to be in contact with the suction surface of a blade 8*c* and the pressure surface of the blade 8*c* adjacent to that blade 8*c*. Consequently, the passing air velocity increases, the airflow resistance increases, and the fan motor input increases.

However, if the maximum thickness portion is more to the inner circumferential end 15*b*, in the outlet-side air passage E2 after a flow collides a the inner circumferential end 15*b*, the flow separates without reattaching onto the surface of the blade 8*c* up to the outer circumferential curved surfaces Bp1 and Bs1, the passing air velocity increases, loss increases, and the fan motor input increases.

To overcome this, in Embodiment 1, the blade 8*c* is formed so that Lt/Lo falls within an optimal range.

As illustrated in FIG. 13, in Embodiment 1, by forming the blade 8*c* so as to satisfy 40%≤Lt/Lo≤50%, flow separation from the blade surface on the inlet side and the outlet side of the impeller can be suppressed, potentially lowering noise, and the power consumption of the fan motor can be decreased. In other words, an indoor unit 100 equipped with a quiet, energy-saving cross-flow fan 8 can be obtained.

[Advantageous Effects of Indoor Unit 100 According to Embodiment 1]

An indoor unit 100 according Embodiment 1 includes a curved surface defined by multiple circular arcs and a straight portion Q, thereby suppressing both flow separation, and generation of more serious noise as the effective inter-blade distance is smaller and the blown air velocity is higher.

In an indoor unit 100 according to Embodiment 1, the thickness of the blade 8*c* is smaller at the outer circumferential end 15*a* than at the inner circumferential end 15*b*, is larger in areas of the blade 8*c* farther from the outer circumferential end 15*a* and closer to the center of the blade 8*c*, takes a maximum at a predetermined position near the center of the blade 8*c*, is smaller in areas of the blade 8*c* closer to the interior of the blade 8*c*, and is approximately equal in the straight portion Q. In this way, the blade 8*c* of the indoor unit 100 is not thin with an approximately equal thickness, thereby suppressing both flow separation, and generation of more serious noise as the effective inter-blade distance is smaller and the blown air velocity is higher.

In an indoor unit 100 according to Embodiment 1, the blade 8*c* is formed so as to satisfy $25\% \geq Hs/Lo > Hp/Lo \geq 10\%$ and $40\% \leq Lt/Lo \leq 50\%$. For this reason, it is possible to suppress more serious noise as the blade thickness is larger, the inter-blade distance is smaller, and the passing air velocity is higher.

An indoor unit 100 according to Embodiment 1 is able to reduce the noise values of overall broadband noise, and prevent backflow to the fan due to instability in the flow of the blown air. As a result, it is possible to obtain a high-quality air-conditioning apparatus that is highly efficient and low-power, quiet with a pleasant sound and low noise, and able to prevent condensation from forming on the impeller and prevent condensation water from being released externally.

Note that although Embodiment 1 describes an example in which both the pressure surface 13*a* and the suction surface 13*b* have a shape defined by multiple circular arcs, the present invention is not limited to such a configuration. In other words, in the blade 8*c*, at least one of the pressure surface 13*a* and the suction surface 13*b* may adopt a shape defined by multiple circular arcs.

Embodiment 2.

Figure 14:
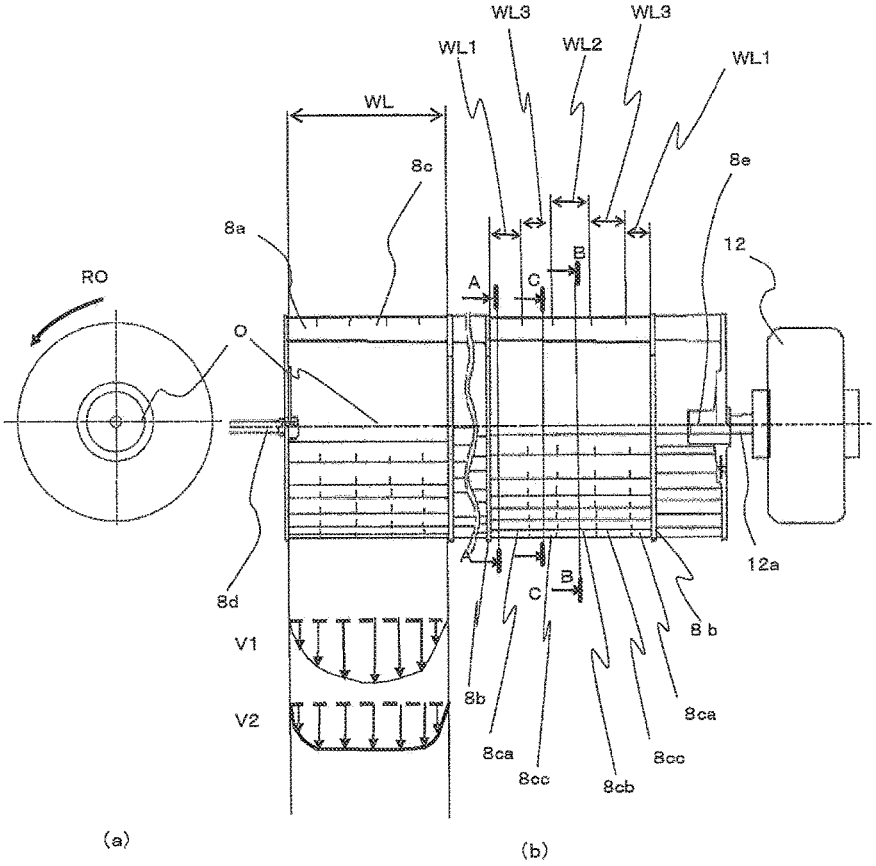
FIG. 14 shows in (a) a front view of an impeller of a cross-flow fan according to Embodiment 2 of the present invention, and in (b) a side view of the impeller of the cross-flow fan.

FIG. 14 shows in (a) a front view of an impeller of a cross-flow fan according to Embodiment 2, and in (b) a side view of the impeller of the cross-flow fan. Note that (a) and (b) in FIG. 14 are diagrams corresponding to (a) and (b), respectively, in FIG. 3 in Embodiment 1.

Figure 15:
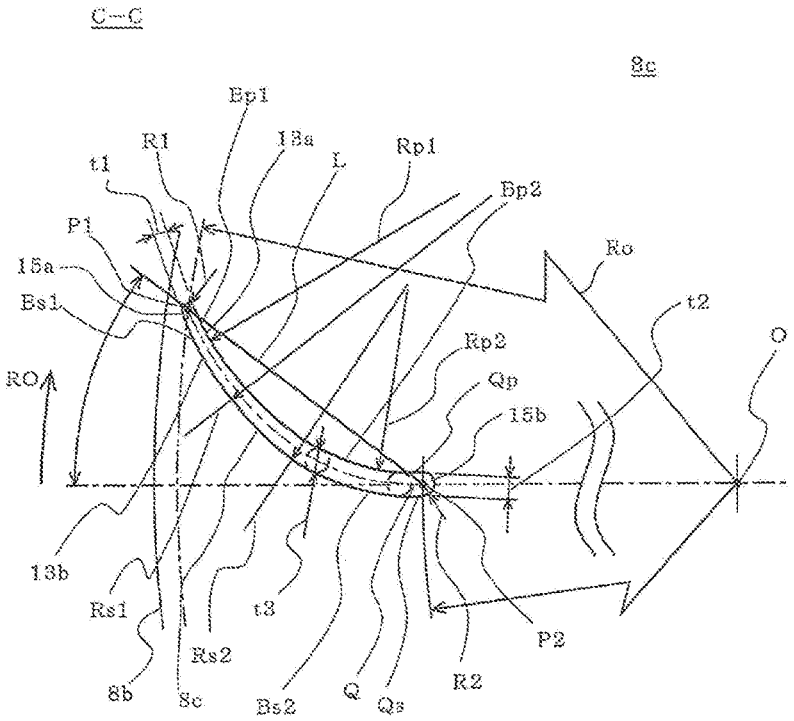
FIG. 15 is a cross-sectional view taken along a line C-C in FIG. 14, and corresponds to FIG. 5 of Embodiment 1.
Figure 16:
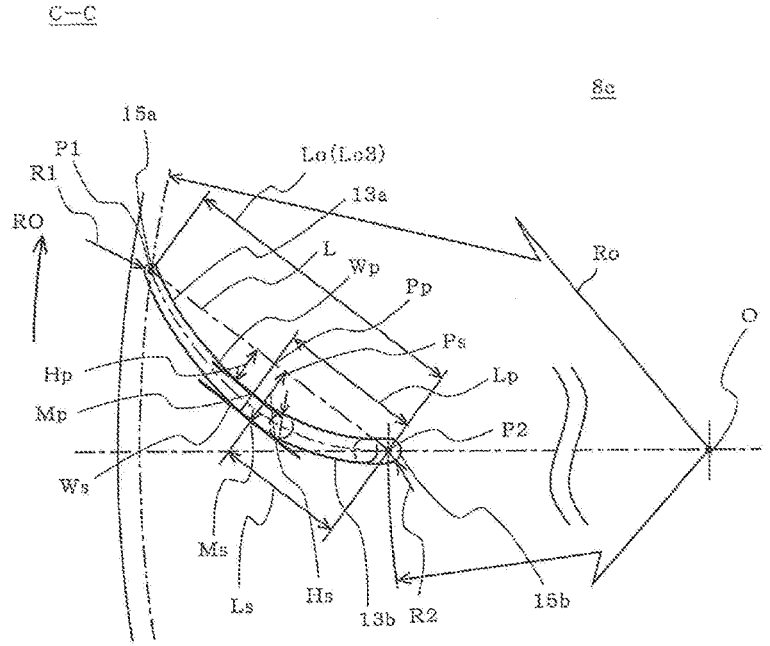
FIG. 16 is a cross-sectional view taken along the line C-C in FIG. 14, and corresponds to FIG. 6 of Embodiment 1.
Figure 17:
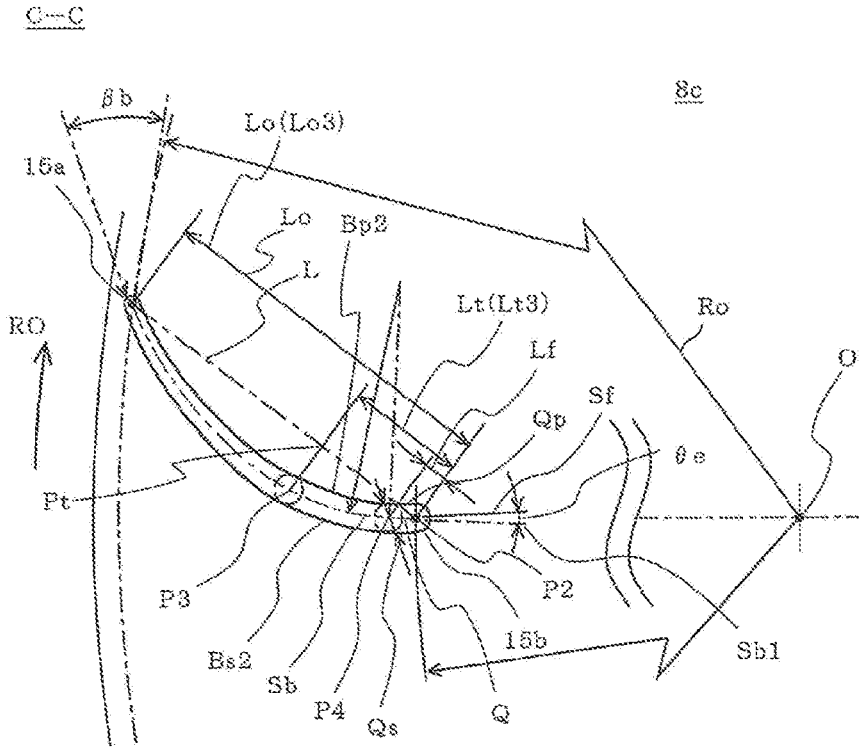
FIG. 17 is a cross-sectional view taken along the line C-C in FIG. 14, and corresponds to FIG. 9 of Embodiment 1.

FIGS. 15 to 17 are cross-sectional views taken along the line C-C in FIG. 14. Note that FIG. 15 corresponds to FIG. 5 of Embodiment 1, FIG. 16 corresponds to FIG. 6 of Embodiment 1, and FIG. 17 corresponds to FIG. 9 of Embodiment 1. Furthermore, FIG. 19 is a schematic perspective view of an impeller of a cross-flow fan according to Embodiment 2, as provided with one blade.

In this case, FIGS. 15 to 17 are cross-sectional views taken along the line C-C perpendicular to the axis of rotation of an inter-blade part 8*cc* that, with respect to a distance WL between two support plates (rings) 8*b* in (b) of FIG. 14, has a predetermined length WL3 between a blade ring proximal portion 8*ca* having a predetermined length WL1 inward into the impeller unit 8*d* from the surface of each ring 8*b*, and a blade central portion 8*cb* having a predetermined length WL2 at the longitudinal center between the two rings 8*b*. Note that since the configuration and various lengths (for example, the blade thickness t and the maximum thickness portion length Lt) illustrated in FIGS. 15 to 17 have been described in Embodiment 1, a repetitive description thereof will be omitted. The configuration of a blade 8*c* of an impeller according to Embodiment 2 will be described in detail with reference to FIGS. 14 to 17, and 19.

Figure 19:
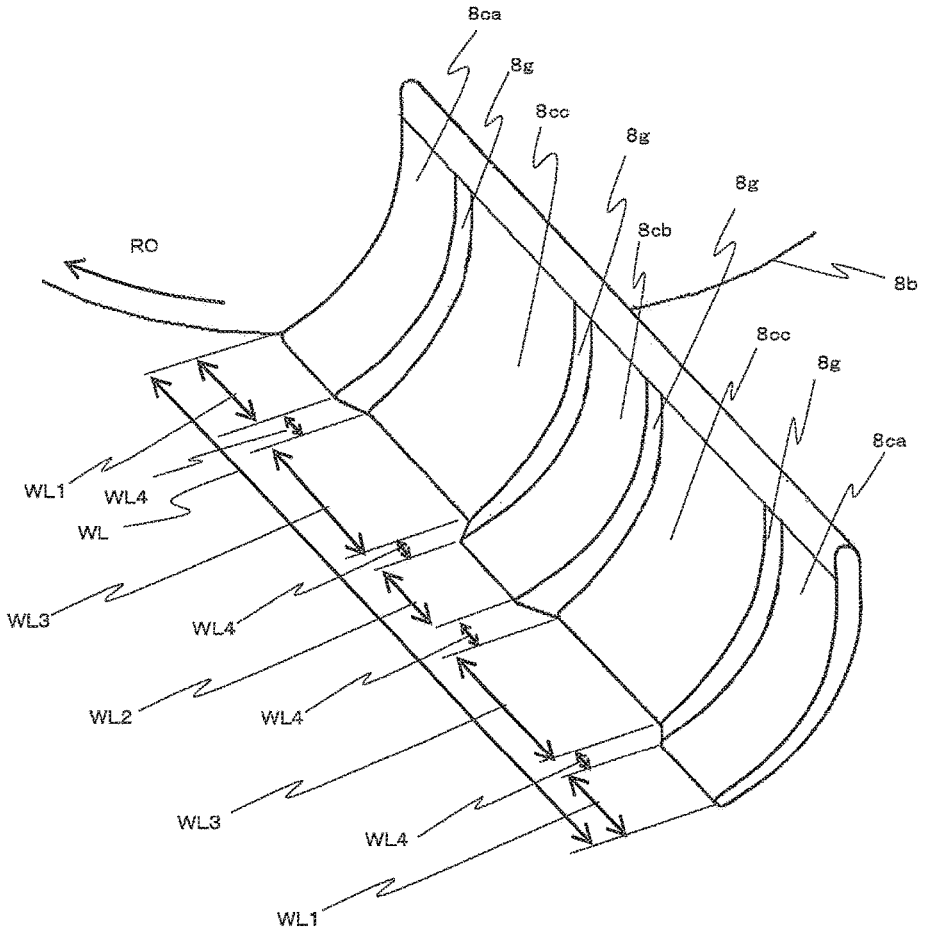
FIG. 19 is a schematic perspective view of an impeller of a cross-flow fan according to Embodiment 2 of the present invention, as provided with one blade.

As illustrated in FIG. 19, a blade 8*c* according to Embodiment 2 is divided into three areas along the breadth of the blade 8*c* in the longitudinal direction. These three areas are, when formed into the impeller, a blade ring proximal portion 8*ca* provided at its two ends adjacent to the rings 8*b*, a blade central portion 8*cb* provided in the blade central portion, and an inter-blade part 8*cc* provided between the blade ring proximal portion 8*ca* and the blade central portion 8*cb*. The blade ring proximal portion 8*ca* will also be referred to as the first area, the blade central portion 8*cb* as the second area, and the inter-blade part 8*cc* as the third area hereinafter.

A joining part 8*g* is provided between the first area and the third area as a first joining part curved in conformity to the concave shape of the blade 8*c*. In other words, the first area and the third area are connected by the joining part 8*g*.

Also, a joining part 8*g* is provided between the third area and the second area as a second joining part curved to correspond with the concave shape of the blade 8*c*. In other words, the third area and the second area are connected by the joining part 8*g*.

Note that the joining part 8*g*, when viewed in the longitudinal direction of the blade 8*c*, slopes from one side to the other side. In other words, as illustrated in FIG. 19, the joining part 8*g* is also sloped in the longitudinal direction, in addition to having a slope in the widthwise direction due to the concave shape of the blade 8*c*.

More specifically, as illustrated in FIG. 19, the joining part 8*g* is sloped so that the third area side is disposed farther back in the blade rotational direction than the first area side. In other words, the joining part 8*g* is sloped so that the third area is positioned deeper into the page than the first area.

Also, the joining part 8*g* is sloped so that the third area side is disposed farther back in the blade rotational direction than the second area side. In other words, the joining part 8*g* is sloped so that the third area is positioned deeper into the page than the second area.

Referring to FIG. 19, let WL1 be the breadth of the blade ring proximal portion 8*ca* in the longitudinal direction of the blade 8*c*, WL2 be the breadth of the blade central portion 8*cb*, and WL3 be the breadth of the inter-blade part 8*cc*.

Referring again to FIG. 19, let WL4 be the breadth of the joining part 8*g* in the longitudinal direction of the blade 8*c*.

Also, let WL be the length of the blade 8*c* in the longitudinal direction of the blade 8*c*, that is, the total length.

Constituent components near the blade 8*c* are arranged in the longitudinal direction of the blade 8*c* in the following order.

More specifically, the blade 8*c* is provided, in sequence, with a ring 8*b* on one side that serves as a support plate, a blade ring proximal portion 8*ca* on one side, a joining part 8*g*, an inter-blade part 8*cc* on one side, a joining part 8*g*, a blade central portion 8*cb*, a joining part 8*g*, an inter-blade part 8*cc* on its other side, a joining part 8*g*, a blade ring proximal portion 8*ca* on its other side, and a ring 8*b* on its other side that serves as a support plate. The blade 8*c* thus includes five areas and four joining parts 8*g* between the rings 8*b* at two ends.

In addition, the blade ring proximal portion 8*ca*, blade central portion 8*cb*, and inter-blade part 8*cc* of a blade 8*c* according to Embodiment 2 are formed in the same longitudinal shape along the breadth of the predetermined lengths WL1, WL2, and WL3, respectively.

Figure 18:
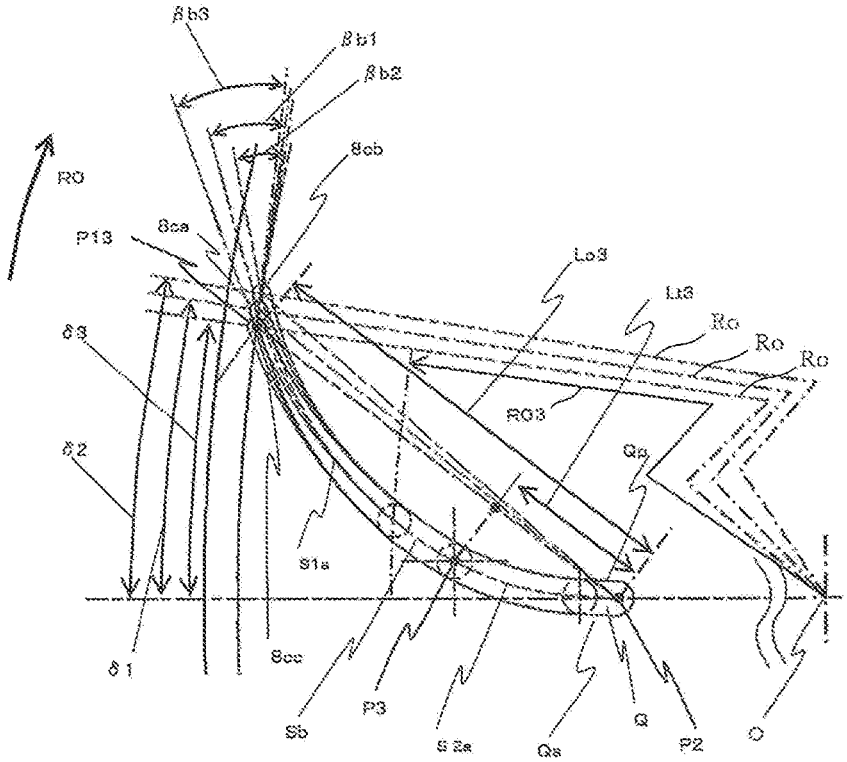
FIG. 18 is a diagram illustrating a superposition of the cross-sections taken along the lines A-A, B-B, and C-C in FIG. 14.

FIG. 18 is a diagram illustrating a superposition of the cross-sections taken along the lines A-A, B-B, and C-C in FIG. 14. More specifically, FIG. 18 is a view of superposition of a cross-section taken along the line A-A perpendicular to the axis of rotation of the blade ring proximal portion 8*ca* that, with respect to the distance WL between the two support plates (rings) 8*b* in (b) of FIG. 14, has a predetermined length WL1 inward into the impeller unit 8*d* from the surface of each ring 8*b*, a cross-section taken along the line B-B perpendicular to the axis of rotation of the blade central portion 8*cb* having a predetermined length WL2 at the longitudinal center between the two rings 8*b*, and a cross-section taken along the line C-C perpendicular to the axis of rotation of the inter-blade part 8*cc* having a predetermined length WL3 between the blade ring proximal portion 8*ca* and the blade central portion 8*cb*. Specifications of the blade 8*c* such as the outer diameter of the blade 8*c* will be described with reference to FIG. 18.

Referring to FIG. 18, which illustrates a superposition of the cross-sections taken along the lines A-A, B-B, and C-C in FIG. 14, the outer diameter Ro of the straight line O-P1 connecting the circular arc center P1 of the outer circumferential end 15*a* of the circular arc of the blade 8*c* to the impeller center of rotation O is approximately equal for the blade ring proximal portion 8*ca*, the blade central portion 8*cb*, and the inter-blade part 8*cc*, and the impeller effective outer radius that forms the diameter of a circle circumscribed by all blades is equal in the longitudinal direction.

In other words, in vertical cross-sections of the blades 8*c* when sequentially viewed in the axis of rotation direction of the impeller, the value of the outer diameter Ro is approximately equal in all of these vertical cross-sections.

In addition, the blade 8*c* according to Embodiment 2 may also be formed so that the outer diameter Ro corresponding to line segment connecting the axis of rotation of the impeller and the outer circumferential end 15*a* of the blade 8*c* in a blade cross-section perpendicular to the impeller axis of rotation of the cross-flow fan 8 becomes approximately equal in areas of the blade 8*c* defined from one end to the other end in the longitudinal direction, that is, the impeller axis of rotation direction.

In this way, in the longitudinal direction, that is, the impeller axis of rotation direction of the cross-flow fan 8, the outer diameter Ro of the outer circumferential end 15*a* of the blade 8*c* in a blade cross-sectional view perpendicular to the impeller axis of rotation is approximately equal, and thus, compared to a blade shape in which the outer diameter varies in the impeller axis of rotation direction as in the related art, leakage flow at the stabilizer that provides a partition between the inlet and outlet areas of the impeller can be suppressed, and efficiency may be improved.

At this point, the blade outlet angle will be described.

The thickness centerline between the surface on the side of the rotational direction RO of the blade 8*c* (pressure surface) 13*a* and the surface on the counter-rotational side (suction surface) 13*b* is defined as a bend line Sb. Then, an outer circumferential side bend line S1*a* may be defined to be the bend line Sb outward from a predetermined radius R03 from the impeller center of rotation O, and an inner circumferential side bend line S2*a* may be defined to be the bend line inward past the predetermined radius R03 from the impeller center of rotation O.

Also, for a circle having as its center the impeller center of rotation O and passing through the circular arc center P1 of the outer circumferential end 15*a* of the blade 8*c*, a tangent to that circle at the circular arc center P1 may be drawn.

A blade outlet angle βb refers to the narrow angle obtained between this tangent and the outer circumferential side bend line S1*a*.

Consequently, as illustrated in FIG. 18, let βb1 be the blade outlet angle of the first area (blade ring proximal portion 8*ca*), let βb2 be the blade outlet angle of the second area (blade central portion 8*cb*), and let βb3 be the blade outlet angle of the third area (the inter-blade part 8*cc* between the blade ring proximal portion 8*ca* and the blade central portion 8*cb*).

The first area (blade ring proximal portion 8*ca*), the second area (blade central portion 8*cb*), and the third area (the inter-blade part 8*cc* between the blade ring proximal portion 8*ca* and the blade central portion 8*cb*) have different blade outlet angles. In other words, the blade outlet angle βb1, the blade outlet angle βb2, and the blade outlet angle βb3 are set to different values.

Also, a shape is preferably formed in which the outer circumferential side of the blade central portion 8*cb* is slanted forward in the impeller rotational direction RO relative to other areas, while the outer circumferential side of the inter-blade part 8*cc* is slanted backward relative to other areas. The outer circumferential end 15*a* thus faces farthest in the counter-rotational direction with a trailing blade cross-sectional shape in the third area, and faces farthest in the rotational direction with a forward blade cross-sectional shape in the second area. More specifically, the blade outlet angle βb1, the blade outlet angle βb2, and the blade outlet angle βb3 preferably satisfy a relation $\beta b2<\beta b1<\beta b3$.

Also, the angle that a straight line passing through the impeller center of rotation O and the circular arc center P2 of the inner circumferential end 15*b* of the blade 8*c*, and a straight line passing through the impeller center of rotation O and the circular arc center P1 of the outer circumferential end 15*a* of the blade 8*c* make with each other is defined as a forward angle.

Additionally, as illustrated in FIG. 18, let δ1 be the forward angle of the first area (blade ring proximal portion 8*ca*), δ2 be the forward angle of the second area (blade central portion 8*cb*), and δ3 be the forward angle of the third area (the inter-blade part 8*cc* between the blade ring proximal portion 8*ca* and the blade central portion 8*cb*).

The blade outlet angles βb, described earlier, have a relation $\beta b2<\beta b1<\beta b3$, which can be rewritten as a relation among the forward angles δ: $\delta 3<\delta 1<\delta 2$.

In this way, the blade 8*c* is divided into a plurality of areas in the longitudinal direction between a pair of support plates, such that when formed into the impeller, the blade 8*c* is divided into an area which is provided at the two ends of the blade 8*c* that are adjacent to the support plates and is defined as the first area, a blade central portion defined as the second area, and an area which is provided on two sides of the blade central portion between the first area and the second area and is defined as a third area. Additionally, since each area has a shape with a different blade outlet angle βb and forward angle δ and takes an appropriate blade outlet angle βb and forward angle δ, flow separation is suppressed, and noise is reduced.

Consequently, compared to a blade having the same blade shape in the longitudinal direction, an energy-efficient and quiet indoor unit for an air-conditioning apparatus equipped with an even more efficient, low-noise cross-flow fan is obtained.

As illustrated in FIG. 14, with a cross-flow fan of the related art having the same blade cross-sectional shape in the longitudinal direction, the air velocity distribution in the outlet height direction is one like the air velocity distribution V1, in which the air velocity is relatively fast in the center part between the rings, but slow in the blade ring proximal portion 8*ca* because of the effects of frictional loss on the surface of the rings 8*b*.

On the other hand, with the cross-flow fan 8 of Embodiment 2, the air velocity distribution becomes like that indicated by V2. In this way, since the blade central portion 8*cb* has the smallest blade outlet angle βb2 (largest blade forward angle) and projects into the blade rotational direction RO with a shape having a small inter-blade distance, it is possible to keep a flow from becoming overly concentrated in the longitudinal center part between the rings. Also, the inter-blade part 8*cc* has the largest blade outlet angle βb3 (smallest forward angle), blowing air in the radial direction relative to the other areas (the first area and the second area), and by also widening the distance between the blade 8*c* and an adjacent blade 8*c* in the blade rotational direction RO, the air velocity can be reduced.

Also, the low-velocity ring proximal portion 8*ca* has a small blade outlet angle βb1 (large forward angle), and the inter-blade distance is reduced. Consequently, the generation of turbulence due to flow instability can be prevented, and the air velocity can be increased.

Furthermore, the flow is not dispersed with the outer circumferential end 15*a* to suppress turbulence by shaping the outer circumferential end 15*a* into a wave shape curved more in the longitudinal direction as in the related art. Instead, in Embodiment 2, since the blade shape varies due to disposing areas having different blade outlet angles βb in rectangular shapes with predetermined, fixed breadths, the blow direction of the impeller in the longitudinal direction is controlled to uniform the distribution of air velocity toward the downstream outlet.

As a result, compared to a blade having the same blade shape in the longitudinal direction, an energy-efficient and quiet indoor unit for an air-conditioning apparatus equipped with an even more efficient, low-noise cross-flow fan is obtained.

Figure 20:
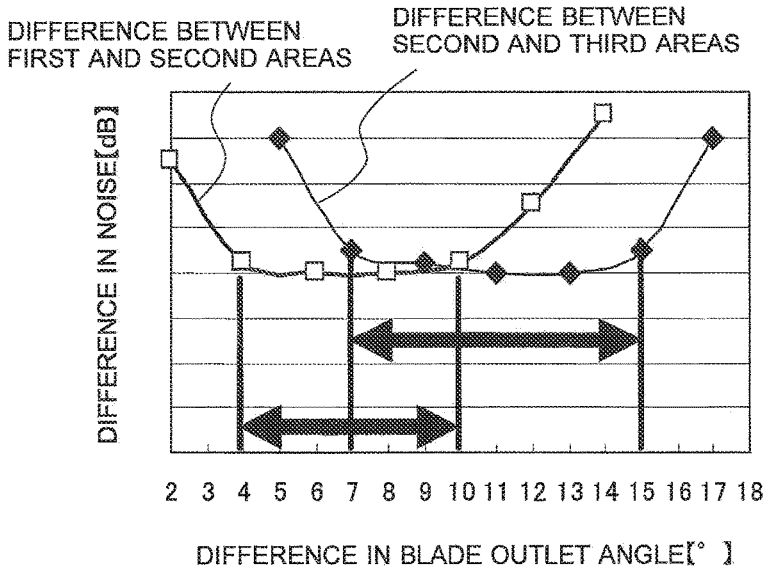
FIG. 20 is a diagram for explaining the relationship between the difference in blade outlet angle at the blade outer circumferential end in each area, and the difference in noise.

FIG. 20 is a diagram for explaining the relationship between the difference in blade outlet angles at the outer circumferential end in each area, and the difference in noise. More specifically, FIG. 20 illustrates the relationship diagram between the difference in blade outlet angle at each outer circumferential end of each of the third area and the second area, and the noise level, as well as the relationship diagram between the blade outlet angle at each outer circumferential end of the first area and the second area, and the noise level.

If the difference in the blade outlet angle βb between adjacent areas is too large, the difference in passing air velocity for each will be too large, producing shear turbulence, and degrading efficiency as well as noise. Accordingly, an appropriate range exists for the difference in the blade outlet angle between adjacent areas.

As illustrated in FIG. 20, the blade 8*c* may maintain low noise by being shaped into a blade so that the difference in the blade outlet angle at the outer circumferential end 15*a* of each of the third area and the second area is 7 degrees to 15 degrees, and so that the difference in the blade outlet angle at the outer circumferential end 15*a* of each of the first area and the second area is 4 degrees to 10 degrees.

In addition, the five areas with difference blade outlet angles are joined by joining parts 8*g* with an oblique face, and not by an approximately right-angled difference. For this reason, a sudden flow change on the blade surface is not produced, and thus turbulence due to a difference in level is not produced.

Consequently, the air velocity distribution in the flow direction is made uniform, and since the load torque is reduced by eliminating areas of localized high air velocity, the power consumption of the motor can be reduced. In addition, since localized high-velocity flows also do not hit the air vanes disposed downstream, the airflow resistance can be reduced, and furthermore the load torque can be reduced.

Also, since the air velocity on the air vanes is made uniform and areas of localized high velocity are eliminated, noise due to boundary layer turbulence at the air vane surface may also be reduced.

In this way, with the blade shape of the present invention, separation is potentially prevented and the air velocity distribution is potentially made uniform on both the outer circumferential side and the inner circumferential side of the impeller, thereby obtaining a highly efficient and low-noise cross-flow fan, as well an indoor unit 100 equipped with such an energy efficient and quiet cross-flow fan 8.

Figure 21:
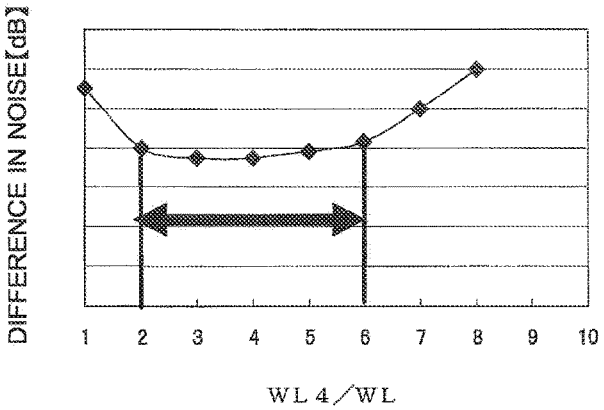
FIG. 21 is a diagram for explaining the relationship between the ratio of the joining part blade length WL4 to the inter-ring blade length WL, and the difference in noise.

FIG. 21 is a diagram for explaining the relationship between the ratio of the blade length WL4 of the joining part to the blade length WL between the rings 8*b*, and the difference in noise.

However, if the blade length of the joining part 8*g* is too long, the blade surface area that provides primary functionality decreases, and performance degrades. Accordingly, an appropriate range exists for the blade length of the joining part 8*g*.

As in FIG. 21, low noise is maintained by forming a blade so that the ratio of the blade length WL4 of each joining part that joins respective areas with respect to the blade length WL between the support plates is 2% to 6%.

Additionally, in each of the first, second, and third areas, the blade is formed so as to have a straight portion with a flat surface and an approximately equal thickness on the side of the inner circumferential end 15*b*, and the blade cross-sectional shape varies in the longitudinal direction of the impeller on the outer circumferential side, while in the straight portion, the blade cross-sectional shape becomes equal in the longitudinal direction of the impeller. For this reason, a negative pressure is generated on the flat surface Qs, and a flow that is about to separate on the inner circumferential curved surface Bs2 will reattach.

Furthermore, since the flat surface Qs is flat, the blade thickness t has no steep positive gradient toward the impeller outer circumference, unlike in the case of a curved surface, and the frictional resistance can thus be kept low.

Also, since parts with the same shape are included in the impeller axis direction, bending produced due to resin flow or cooling caused by unevenness during resin molding can be suppressed, making assembly and fabrication easier.

Figure 22:
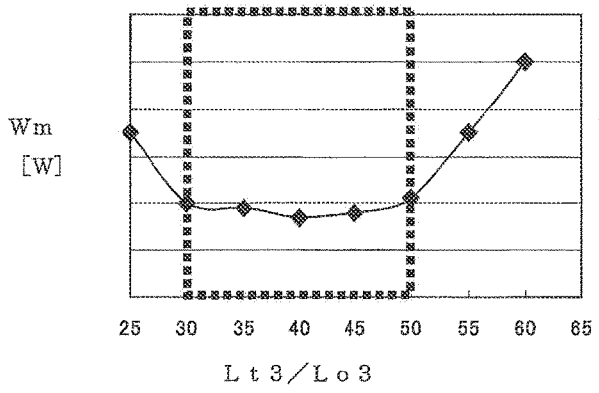
FIG. 22 is a diagram for explaining the relationship between the ratio of the straight portion chord length Lt3 to the chord length Lo3 in the third area, and the fan motor input Wm.

FIG. 22 is a diagram for explaining the relationship between the ratio of the straight portion chord length Lt3 to the chord length Lo3 in the third area, and the fan motor input Wm.

When viewed in a vertical cross-sectional view of the blade 8*c*, the outer circumferential end 15*a* and the inner circumferential end 15*b* of the blade 8*c* are individually formed by circular arcs. Let Lo be the chord length of a chord line which is a line segment connecting the circular arc center P1 of the outer circumferential end 15*a* and the circular arc center P2 of the inner circumferential end 15*b*, and Lo3 be the chord length in the third area.

Also, the intersection point between a normal which is dropped from a chord line and passes through the center of a circle inscribed in the pressure surface 13*a* and the suction surface 13*b* in the maximum thickness portion of the blade 8*c*, and the chord line is defined as a maximum thickness portion chord point Pt. Furthermore, the distance between the circular arc center P2 of the inner circumferential end 15*b* and the maximum thickness portion chord point is defined as a straight portion chord length Lt, and the straight portion chord length in the third area (inter-blade part 8*cc*) is defined as a straight portion chord length Lt3.

According to FIG. 22, by forming the blade 8*c* so as to satisfy 30%≤Lt3/Lo3≤50%, for example, fan motor input may be kept low, and an energy efficient indoor unit for an air-conditioning apparatus is obtained.

Also, since the blade 8*c* according to Embodiment 2 has a different blade outlet angle βb in each area, flow separation from the blade surface can be suppressed, and the range of the maximum thickness position may be widened.

Figure 23:
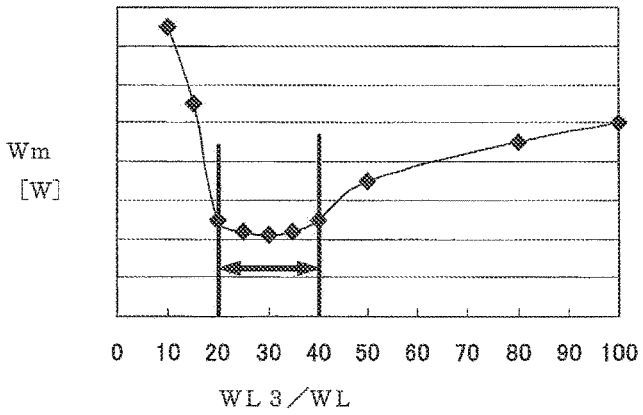
FIG. 23 is a diagram for explaining the relationship between WL3/WL and the fan motor input.

FIG. 23 is a diagram for explaining the relationship between WL3/WL and the fan motor input.

Additionally, if the blade length WL3 of the third area is too short with respect to the blade length WL between the rings 8*b* that act as support plates, the inter-blade distance narrows in the overall blade length direction, and the inter-blade air velocity increases. For this reason, the fan motor input lowers. On the other hand, if the blade length WL3 of the third area is too long with respect to the blade length WL between the rings 8*b* that act as support plates, the blade shape has the same blade outlet angle βb in the blade length direction (WL3/WL=100%), and the difference becomes smaller. For this reason, an appropriate range exists for the blade length WL3 of the third area with respect to the blade length WL between the support plates.

As illustrated in FIG. 23, by forming the blade 8*c* so that WL3/WL is 20% to 40%, for example, fan motor input may be kept low, and an energy efficient indoor unit for an air-conditioning apparatus is obtained.

The invention claimed is:

1. An indoor unit for an air-conditioning apparatus, comprising:

a main body that includes an air inlet and an air outlet;

a cross-flow fan that is provided inside the main body and includes an impeller configured to, by rotation, draw air into the main body from the air inlet and blow the air from the air outlet;

a stabilizer configured to partition a space inside the main body into an inlet-side air passage, which is on an upstream side of the cross-flow fan, and an outlet-side air passage, which is on a downstream side of the cross-flow fan;

a blade included in the impeller; and a support plate configured to support the blade, the support plate being provided at one end and other end of the blade in a longitudinal direction, wherein the blade is formed so that, when viewed in a vertical cross-sectional view of the blade, a pressure surface of the blade and a suction surface of the blade, which is opposite to the pressure surface, are curved more in a rotational direction, in which the impeller rotates, in areas farther from an axis of rotation of the impeller and closer to an exterior of the blade, the pressure surface and the suction surface form a curved surface including at least one circular arc, and a straight portion of the blade is formed to be connected to the curved surface on one side thereof and extend toward an inner end of the blade on another side thereof and is defined by a flat surface, which is continuous with a surface formed by a circular arc out of the pressure surface and the suction surface, when the blade is divided into a plurality of areas in the longitudinal direction between one support plate and another support plate, such that when formed into the impeller, an area provided at two ends of the blade that are adjacent to the support plates is defined as a first area, a blade central portion is defined as a second area, and an area provided on two sides of the blade central portion between the first area and the second area is defined as a third area, and the blade is formed so that, provided that an outer end of the second area is slanted forward in the rotational direction relative to an outer end of the first area, and the outer end of the first area is slanted forward in the rotational direction relative to an outer end of the third area, an inequality δ3<δ1<δ2 is satisfied, where δ1 is a forward angle of the first area, δ2 is a forward angle of the second area, and δ3 is a forward angle of the third area.

2. An indoor unit for an air-conditioning apparatus, comprising:

a main body that includes an air inlet and an air outlet;

a cross-flow fan that is provided inside the main body, and includes an impeller configured to, by rotation, draw air into the main body from the air inlet and blow the air from the air outlet; and a stabilizer configured to partition a space inside the main body into an inlet-side air passage which is on an upstream side of the cross-flow fan, and an outlet-side air passage which is on a downstream side of the cross-flow fan, wherein a blade included in the impeller is formed so that, when viewed in a vertical cross-sectional view of the blade, a pressure surface of the blade and a suction surface of the blade, which is opposite to the pressure surface, are curved more in a rotational direction in which the impeller rotates in areas farther from an axis of rotation of the impeller and closer to an exterior of the blade, the pressure surface and the suction surface form a curved surface including at least one circular arc, a straight portion of the blade is formed to be connected to the curved surface at one end of the straight portion and to extend toward an inner end of the blade at an opposite end of the straight portion, the straight portion is defined by a flat surface, which is continuous with a surface formed by the at least one circular arc, the straight portion is formed only on an end of the blade that is nearest the axis of rotation of the impeller, a support plate configured to support the blade is provided at one end and other end of the blade in a longitudinal direction, the blade is formed so that in a blade cross-section perpendicular to an axis of rotation of the impeller of the cross-flow fan, an outer diameter corresponding to a line segment connecting the axis of rotation of the impeller and an outer end of the blade is equal across a distance from the one end to the other end in the longitudinal direction which matches an axis of rotation direction of the impeller, when the blade is divided into a plurality of areas in the longitudinal direction between one support plate and another support plate, such that when formed into the impeller, an area provided at two ends of the blade that are adjacent to the support plates is defined as a first area, a blade central portion is defined as a second area, and an area provided on two sides of the blade central portion between the first area and the second area is defined as a third area, a blade outlet angle varies among the first area, the second area, and the third area, and a difference in blade outlet angle at the outer end of each of the third area and the second area is 7 degrees to 15 degrees.

3. An indoor unit for an air-conditioning apparatus, comprising:

a main body that includes an air inlet and an air outlet;

a cross-flow fan that is provided inside the main body, and includes an impeller configured to, by rotation, draw air into the main body from the air inlet and blow the air from the air outlet; and a stabilizer configured to partition a space inside the main body into an inlet-side air passage which is on an upstream side of the cross-flow fan, and an outlet-side air passage which is on a downstream side of the cross-flow fan, wherein a blade included in the impeller is formed so that, when viewed in a vertical cross-sectional view of the blade, a pressure surface of the blade and a suction surface of the blade, which is opposite to the pressure surface, are curved more in a rotational direction in which the impeller rotates in areas farther from an axis of rotation of the impeller and closer to an exterior of the blade, the pressure surface and the suction surface form a curved surface including at least one circular arc, a straight portion of the blade is formed to be connected to the curved surface at one end of the straight portion and to extend toward an inner end of the blade at an opposite end of the straight portion, the straight portion is defined by a flat surface, which is continuous with a surface formed by the at least one circular arc, the straight portion is formed only on an end of the blade that is nearest the axis of rotation of the impeller, a support plate configured to support the blade is provided at one end and other end of the blade in a longitudinal direction, the blade is formed so that in a blade cross-section perpendicular to an axis of rotation of the impeller of the cross-flow fan, an outer diameter corresponding to a line segment connecting the axis of rotation of the impeller and an outer end of the blade is equal across a distance from the one end to the other end in the longitudinal direction which matches an axis of rotation direction of the impeller, and when the blade is divided into a plurality of areas in the longitudinal direction between one support plate and another support plate, such that when formed into the impeller, an area provided at two ends of the blade that are adjacent to the support plates is defined as a first area, a blade central portion is defined as a second area, and an area provided on two sides of the blade central portion between the first area and the second area is defined as a third area, a blade outlet angle varies among the first area, the second area, and the third area, the blade includes a first joining part that connects the first area and the third area to each other, and a second joining part that connects the third area and the second area to each other, in the longitudinal direction, which matches the axis of rotation direction of the impeller of the cross-flow fan, the first joining part and the second joining part are sloped from an area connected on one side to an area connected on other side, and the blade is formed so that a ratio of a length of the first joining part and the second joining part in the longitudinal direction of the blade to a blade length defined by a distance between the support plate at the one end and the support plate at the other end is 2% to 6%.

* * * * *